US012005302B2

(12) United States Patent
Manzke et al.

(10) Patent No.: US 12,005,302 B2
(45) **Date of Patent: *Jun. 11, 2024**

(54) EXERCISE APPARATUS

(71) Applicant: JOHNSON HEALTH TECH CO., LTD, Taichung (TW)

(72) Inventors: Russell C. Manzke, Daya District (TW); Ryan Francis Crist, Daya District (TW)

(73) Assignee: JOHNSON HEALTH TECH CO., LTD, Taichung (TW)

( * ) Notice: Subject to any disclaimer, the term of this patent is extended or adjusted under 35 U.S.C. 154(b) by 160 days.

This patent is subject to a terminal disclaimer.

(21) Appl. No.: 17/509,901

(22) Filed: Oct. 25, 2021

(65) Prior Publication Data

US 2022/0040528 A1 Feb. 10, 2022

Related U.S. Application Data

(63) Continuation-in-part of application No. 17/486,801, filed on Sep. 27, 2021, which is a continuation of (Continued)

(51) Int. Cl.
*A63B 22/02* (2006.01)
*A63B 21/00* (2006.01)
(Continued)

(52) U.S. Cl.
CPC ..... *A63B 22/02* (2013.01); *A63B 21/00069* (2013.01); *A63B 22/0023* (2013.01); (Continued)

(58) Field of Classification Search
CPC ..... A63B 69/0057; A63B 22/0023; A63B 21/00069; A63B 23/047; A63B 2225/093; (Continued)

(56) References Cited

U.S. PATENT DOCUMENTS 1,766,089 A 6/1930 Wood
2,017,128 A 10/1935 O'Neill, Jr.
(Continued)

FOREIGN PATENT DOCUMENTS

CN 106938132 A 7/2017
EP 3395412 A1 10/2018
WO WO 2013124930 A1 8/2013

OTHER PUBLICATIONS

Technogym, "Skillrun Catalogue," <https://pdf.archiexpo.com/pdf/technogym/skillrun/5169-321079.html> dated 2019.

*Primary Examiner* — Andrew S Lo
(74) *Attorney, Agent, or Firm* — Michael Best & Friedrich LLP

(57) ABSTRACT

An exercise apparatus comprises a platform having a front roller, a rear roller and an endless belt mounted around the front roller and the rear roller for allowing a user to perform a first exercise type of a relatively lower resistance or a second exercise type of a relatively higher resistance. A front frame is mounted at a front side of the platform and has at least one holding portion adapted to be grasped by the user. One or more control interfaces controls the first exercise type and the second exercise type.

15 Claims, 17 Drawing Sheets

Related U.S. Application Data application No. 16/540,071, filed on Aug. 14, 2019, now Pat. No. 11,135,472, and a continuation of application No. 16/458,540, filed on Jul. 1, 2019, now Pat. No. 11,154,746, which is a continuation of application No. 15/791,423, filed on Oct. 24, 2017, now Pat. No. 10,398,933, said application No. 16/540,071 is a continuation-in-part of application No. 15/499,897, filed on Apr. 28, 2017, now Pat. No. 10,857,407, said application No. 15/791,423 is a continuation-in-part of application No. 14/925,682, filed on Oct. 28, 2015, now Pat. No. 9,814,930, said application No. 15/499,897 is a continuation-in-part of application No. 14/726,622, filed on Jun. 1, 2015, now Pat. No. 9,675,838, said application No. 14/925,682 is a continuation-in-part of application No. 14/726,622, filed on Jun. 1, 2015, now Pat. No. 9,675,838.

(51) Int. Cl.

| | |
|---|---|
| ***A63B 21/005*** | (2006.01) |
| ***A63B 21/015*** | (2006.01) |
| ***A63B 21/02*** | (2006.01) |
| ***A63B 21/04*** | (2006.01) |
| ***A63B 21/055*** | (2006.01) |
| ***A63B 21/22*** | (2006.01) |
| ***A63B 22/00*** | (2006.01) |
| ***A63B 23/04*** | (2006.01) |
| ***A63B 69/00*** | (2006.01) |
| ***A63B 71/00*** | (2006.01) |

(52) U.S. Cl.

CPC ..... *A63B 23/047* (2013.01); *A63B 69/0057* (2013.01); *A63B 21/0051* (2013.01); *A63B 21/015* (2013.01); *A63B 21/023* (2013.01); *A63B 21/0407* (2013.01); *A63B 21/0414* (2013.01); *A63B 21/0552* (2013.01); *A63B 21/225* (2013.01); *A63B 22/0242* (2013.01); *A63B 2071/009* (2013.01); *A63B 2209/08* (2013.01); *A63B 2225/093* (2013.01)

(58) Field of Classification Search

CPC ..... A63B 2209/08; A63B 2071/009; A63B 22/0242; A63B 21/225; A63B 21/0552; A63B 21/0414; A63B 21/023; A63B 21/015; A63B 21/0051; A63B 21/0407; A63B 69/0028; A63B 22/02–0264; A63B 22/0292–06; A63B 22/06–0694

See application file for complete search history.

(56) References Cited

U.S. PATENT DOCUMENTS

| | | | |
|---|---|---|---|
| 2,623,302 | A | 12/1952 | Shields |
| 4,323,237 | A | 4/1982 | Jungerwirth |
| 4,470,597 | A | 9/1984 | McFee |
| 4,659,074 | A | 4/1987 | Taitel et al. |
| 4,659,077 | A | 4/1987 | Stropkay |
| 4,861,021 | A | 8/1989 | Edwards et al. |
| 4,890,495 | A | 1/1990 | Slane |
| 4,898,378 | A | 2/1990 | Edwards et al. |
| 4,960,276 | A | 10/1990 | Feuer et al. |
| 5,100,127 | A | 3/1992 | Melnick et al. |
| 5,176,597 | A | 1/1993 | Bryne |
| 5,203,800 | A | 4/1993 | Meredith |
| 5,234,392 | A | 8/1993 | Clark |
| 5,342,264 | A | 8/1994 | Gordon |
| 5,409,435 | A | 4/1995 | Daniels |
| 5,429,563 | A | 7/1995 | Engel et al. |
| D364,662 | S | 11/1995 | Camfield et al. |
| 5,562,572 | A | 10/1996 | Carmein |
| D375,767 | S | 11/1996 | Camfield et al. |
| 5,656,003 | A | 8/1997 | Robinson et al. |
| 5,704,880 | A | 1/1998 | Amatulle |
| 5,704,881 | A | 1/1998 | Dudley |
| D393,027 | S | 3/1998 | Chen |
| 5,728,029 | A | 3/1998 | Minoura |
| 5,733,226 | A | 3/1998 | Chen |
| 5,762,584 | A | 6/1998 | Daniels |
| 5,941,804 | A | 8/1999 | Johnston et al. |
| 6,027,429 | A | 2/2000 | Daniels |
| 6,042,514 | A | 3/2000 | Abelbeck |
| 6,146,315 | A | 11/2000 | Schonenberger |
| 6,152,854 | A | 11/2000 | Carmein |
| 6,387,015 | B1 | 5/2002 | Watson |
| 6,454,679 | B1 | 9/2002 | Radow |
| 6,500,097 | B1 | 12/2002 | Hall |
| 6,575,876 | B1 | 6/2003 | Phelps-McMillon |
| 6,676,569 | B1 | 1/2004 | Radow |
| 6,878,101 | B2 | 4/2005 | Colley |
| 7,575,537 | B2 | 8/2009 | Ellis |
| 7,628,730 | B1 | 12/2009 | Watterson et al. |
| 7,699,761 | B1 | 4/2010 | Dieter et al. |
| 7,833,133 | B2 | 11/2010 | Stewart et al. |
| 8,343,016 | B1 | 1/2013 | Astilean |
| 8,784,230 | B1 | 7/2014 | Mitchell |
| 8,968,163 | B1 | 3/2015 | Vidmar |
| 9,370,680 | B1 | 6/2016 | Macaulay et al. |
| 9,814,930 | B2 | 11/2017 | Manzke et al. |
| 2002/0022554 | A1 | 2/2002 | Borsheim |
| 2003/0004038 | A1 | 1/2003 | Wroclawsky |
| 2003/0013584 | A1 | 1/2003 | Harney |
| 2004/0087418 | A1 | 5/2004 | Eldridge |
| 2004/0248699 | A1 | 12/2004 | Colley |
| 2005/0009669 | A1 | 1/2005 | Harris |
| 2005/0209056 | A1 | 9/2005 | Daly et al. |
| 2005/0255971 | A1 | 11/2005 | Solomon |
| 2006/0229170 | A1 | 10/2006 | Ozawa et al. |
| 2007/0016444 | A1 | 1/2007 | Holkkola |
| 2007/0042868 | A1 | 2/2007 | Fisher et al. |
| 2007/0083975 | A1 | 4/2007 | Senegal |
| 2007/0123395 | A1 | 5/2007 | Ellis |
| 2007/0123396 | A1 | 5/2007 | Ellis |
| 2007/0167295 | A1 | 7/2007 | Chen |
| 2007/0232465 | A1 | 10/2007 | Puzey |
| 2008/0119337 | A1 | 5/2008 | Wilkins et al. |
| 2009/0011907 | A1 | 1/2009 | Radow et al. |
| 2009/0137367 | A1 | 5/2009 | Hendrickson et al. |
| 2009/0255531 | A1 | 10/2009 | Johnson et al. |
| 2009/0298649 | A1 | 12/2009 | Dyer et al. |
| 2010/0022358 | A1 | 1/2010 | Schwaiger et al. |
| 2010/0151994 | A1 | 6/2010 | Yeh |
| 2010/0204014 | A1 | 8/2010 | Hoffman |
| 2010/0240498 | A1 | 9/2010 | Robinson |
| 2011/0082011 | A1 | 4/2011 | Ellis |
| 2011/0082013 | A1 | 4/2011 | Bastian |
| 2011/0118090 | A1 | 5/2011 | Ellis |
| 2011/0230314 | A1 | 9/2011 | Hoffman et al. |
| 2011/0237399 | A1 | 9/2011 | Tobak et al. |
| 2011/0281691 | A1 | 11/2011 | Ellis |
| 2012/0010048 | A1 | 1/2012 | Bayerlein et al. |
| 2012/0018249 | A1 | 1/2012 | Mehr |
| 2012/0040802 | A1 | 2/2012 | Dibble et al. |
| 2012/0142501 | A1 | 6/2012 | Piaget et al. |
| 2012/0197168 | A1 | 8/2012 | Agrawal et al. |
| 2012/0295769 | A1 | 11/2012 | Pennington |
| 2012/0322624 | A1 | 12/2012 | Wu |
| 2013/0005541 | A1 | 1/2013 | Robinson |
| 2013/0123073 | A1 | 5/2013 | Olson et al. |
| 2013/0165301 | A1 | 6/2013 | Thrasher-Rudd et al. |
| 2013/0172153 | A1 | 7/2013 | Watterson et al. |
| 2013/0184125 | A1 | 7/2013 | Maguire |
| 2013/0241696 | A1 | 9/2013 | Fabrizio |
| 2014/0011642 | A1 | 1/2014 | Astilean |
| 2014/0011645 | A1 | 1/2014 | Johnson et al. |
| 2014/0026893 | A1 | 1/2014 | Johnson et al. |
| 2014/0106936 | A1 | 4/2014 | Puerschel |
| 2014/0141939 | A1 | 5/2014 | Wu |
| 2014/0244575 | A1 | 8/2014 | Giudici et al. |

(56) References Cited

U.S. PATENT DOCUMENTS

| | | | |
|---|---|---|---|
| 2014/0274569 | A1 | 9/2014 | Lewen |
| 2014/0274577 | A1 | 9/2014 | Beard et al. |
| 2014/0274578 | A1 | 9/2014 | Kennedy |
| 2015/0080187 | A1 | 3/2015 | Beane |
| 2015/0224365 | A1 | 8/2015 | Birrell |
| 2015/0238817 | A1 | 8/2015 | Watterson et al. |
| 2015/0238819 | A1 | 8/2015 | Volkerink et al. |
| 2015/0306456 | A1 | 10/2015 | Pasini et al. |
| 2015/0320632 | A1 | 11/2015 | Vallery et al. |
| 2015/0335940 | A1 | 11/2015 | Johnson |
| 2015/0367169 | A1 | 12/2015 | Ashby et al. |
| 2015/0367171 | A1 | 12/2015 | Truong |
| 2016/0001118 | A1 | 1/2016 | Kuehne et al. |
| 2016/0001119 | A1 | 1/2016 | Jue et al. |
| 2016/0008650 | A1 | 1/2016 | Jue et al. |
| 2016/0023039 | A1 | 1/2016 | Cei |
| 2016/0166454 | A1 | 6/2016 | Johnson et al. |
| 2016/0213976 | A1 | 7/2016 | So et al. |
| 2016/0243396 | A1 | 8/2016 | Taylor et al. |
| 2016/0287930 | A1 | 10/2016 | Moser |
| 2016/0346596 | A1 | 12/2016 | Manzke et al. |
| 2017/0136289 | A1 | 5/2017 | Frank |
| 2017/0136290 | A1 | 5/2017 | Cei |
| 2017/0182356 | A1 | 6/2017 | Cei et al. |
| 2017/0274237 | A1 | 9/2017 | Chang |
| 2017/0333743 | A1 | 11/2017 | Kuo |
| 2018/0043206 | A1 | 2/2018 | Crist et al. |
| 2018/0043207 | A1 | 2/2018 | Moser |
| 2018/0099181 | A1 | 4/2018 | Powell et al. |
| 2018/0117401 | A1 | 5/2018 | Chen et al. |
| 2018/0161626 | A1 | 6/2018 | Fung |
| 2018/0200567 | A1 | 7/2018 | Rubin et al. |
| 2019/0070455 | A1 | 3/2019 | Cei |
| 2019/0314675 | A1 | 10/2019 | Frank |
| 2019/0321680 | A1 | 10/2019 | Manzke et al. |
| 2019/0336827 | A1 | 11/2019 | Intonato et al. |
| 2019/0366149 | A1 | 12/2019 | Crist et al. |
| 2021/0236882 | A1 | 8/2021 | Fedriga |
| 2022/0008779 | A1 | 1/2022 | Crist et al. |

EXERCISE APPARATUS

CROSS-REFERENCE TO RELATED APPLICATIONS

This is i) a continuation-in-part of U.S. patent application Ser. No. 17/486,801, filed Sep. 27, 2021, which is a continuation of U.S. patent application Ser. No. 16/540,071, filed on Aug. 14, 2019, now U.S. Pat. No. 11,135,472, which is a continuation-in-part of U.S. patent application Ser. No. 15/499,897, filed on Apr. 28, 2017, now U.S. Pat. No. 10,857,407, which is a continuation-in-part of U.S. patent application Ser. No. 14/726,622, filed Jun. 1, 2015, now U.S. Pat. No. 9,675,838, and ii) a continuation of U.S. patent application Ser. No. 16/458,540, fled Jul. 1, 2019, now U.S. Pat. No. 11,154,746, which is a continuation of U.S. patent application Ser. No. 15/791,423, filed on Oct. 24, 2017, which is a continuation-in-part of U.S. patent application Ser. No. 14/925,682, filed on Oct. 28, 2015, now U.S. Pat. No. 9,814,930, which is a continuation-in-part of U.S. patent application Ser. No. 14/726,622, filed on Jun. 1, 2015, now U.S. Pat. No. 9,675,838, the contents of each of which are hereby incorporated by reference.

BACKGROUND

1. Field of the Invention

The present invention relates to an exercise apparatus. More particularly, the present invention relates to a treadmill.

2. Description of the Related Art

Most treadmills are electrically powered. In operation, the endless belt on the platform of the treadmills is powered by a motor at a predetermined speed for allowing a user to walk, jog or run on the belt. Generally, electric treadmill users can preset a program containing timing variation before exercise so that the treadmill will automatically make the speed of the treadmill become faster or slower at a predetermined point according to the aforementioned program during exercise. Additionally, during exercise, the user could direct the belt to speed up or slow down through a control interface of the treadmill for allowing the user to adjust the exercising speed or change exercise modes (e.g. from walking to jogging). Even so, for the operation of the electric treadmill, it requires the user to walk or run at a speed matching that of the belt, rather than the speed of the belt matching the speed of the user. In short, users cannot immediately speed up or slow down the speed of walking, jogging or running on the electric treadmill like outdoor exercise whenever they want to.

In general, the electric treadmills are usually used for a long period of walking or running (e.g. 20, 30 minutes or more). Moreover, in current commercial treadmills, the upper limit of the adjusting range of the belt running speed is actually up to 24 to 27 km/h, that is equal to one hundred meters just in 13~14 seconds and suitable for a short period of fast-run or sprint. Since everyone has different physical abilities, not all fast-runs or sprints are carried out under maximum-speed operation of the belt. No matter how fast the belt is, when the user performs sprint exercises on the treadmill, the belt is driven by the motor at high speed. Therefore, if the user's running speed cannot keep up with the belt speed, an accident may occur. Furthermore, if the user wants to take a break or end the exercise during the sprint exercise, the user usually has two hands grip two side handrails first, and then has two feet span the belt on two side rails. If the user wants to continue running after the break, the user would step on the belt again and keep up with the belt speed, and then the user could take the two hands off the two side rails for free swinging. It is obvious that the aforementioned motions of the break and the continuance of running have a certain degree of difficulty and danger. For the safety reason, maybe that is why many people never adjust the belt speed up to the high-speed region, even if they are able to sprint with equal speed for a short time on the ground.

Relative to the electric treadmills, nowadays there are some treadmills without electric power in the market. Rather than being powered by an electric motor, the belt is powered by the user when the user walks or runs on the treadmill to push the belt with two feet (further supplemented by inertial force of a flywheel). Generally speaking, since the belt of the non-electric treadmill is rotated with the motion of the user's two feet, the user could speed up or slow down the speed of walking, jogging or running anytime. However, the general non-electric treadmill is not suitable for sprinting. The reason is that: if a user continues to increase the running speed, the forward speed corresponding to the running motion of the user (equal to the step length multiplied by step frequency) may run faster than the sliding speed to the rear of the belt plane such that the user would be close to the front end of the treadmill. In order to keep running in an appropriate region of the belt, users will naturally restrain their running speed and thus the maximum capacity cannot be exerted, so that the desired training effect cannot be achieved.

There is one method in existence trying to solve the above problems, that is, to provide a wearing member attached to the waist or the upper body of the user, e.g. an endless strap that is able to put around the waist or the abdomen of the user, or a vest being able to be worn on the user's body. Moreover, an appropriate length of rope is connected between the wearing member and a holder fixed behind the platform. Thereby, when the user who wears the wearing member exercises on the non-electric treadmill, if the body moves forward to a predetermined position, the body will be pulled by the rope in the rear side (straightened) to restrict the further forward motion of the user. Therefore, the user could practice for quick running or sprint with normal running motion, and to freely slow down or accelerate again in the process of running. There is a disadvantage in the aforementioned method. It requires the user to wear the wearing member before the user exercises on the platform of the treadmill. For example, the user needs to put the endless strap around the waist, and to take off the wearing member from the body after the end of the exercise, it is bothersome for the user. Furthermore, since it needs to install a stationary frame for securing the rear end of the rope behind the platform, the whole device will occupy more space.

On the other hand, the treadmills are generally available only for aerobic exercises of walking, jogging or running, such functions are restricted. One type of exercise apparatus with both functions of treadmill and weight training is shown in U.S. Publication No. 2014/0274578 A1. The exercise apparatus includes a platform of an analogous non-electric treadmill. The platform has a flywheel axially mounted on one end of the front roller and a friction resistance device disposed beside the flywheel. The user can manually adjust the tightness of the resistance device through a knob driving an arcuate brake pad to press against the peripheral surface of the flywheel so as to adjust the rotational resistance of the flywheel and the front roller, namely adjusting the running resistance of the belt. In addition to walking, jogging or running, the user can adjust the resistance to a higher level for making the belt difficult to slide. Then, the user could hold the front handle with two hands, adopting a position with low center of gravity, and pushing the belt backward with two legs so as to simulate a training of pushing a weight forward on the ground (e.g. push sled). As general non-electric treadmills, while walking, jogging or running on the exercise apparatus, the belt needs to have an appropriate resistance depending on the usage condition. However, the friction resistance device is not easy to adjust the resistance to meet the requirement especially for low resistance. If change to an eddy current type resistance device, it is relatively easy to make fine adjustment, but it may not be able to provide high resistance for the weight training.

The present invention has arisen to mitigate and/or obviate the disadvantages of the conventional method. Further benefits and advantages of the present invention will become apparent after a careful reading of the detailed description with appropriate reference to the accompanying drawings.

SUMMARY

The object of the present invention provides an exercise apparatus comprising a platform having a front roller, a rear roller and an endless belt mounted around the front roller and the rear roller for allowing a user to perform a first exercise type of a relatively lower resistance or a second exercise type of a relatively higher resistance. The exercise apparatus further comprises a front frame mounted at a front side of the platform, and having at least one holding portion adapted to be grasped by the user. The exercise apparatus further comprises a first control interface configured to control the first exercise type. The first exercise type is selected from a group consisting of walking, jogging, and running. The exercise apparatus further comprises a second control interface configured to control the second exercise type. The second exercise type includes the user pushing the endless belt backwards against resistance while grasping the holding portion.

Another object of the present invention provides an exercise apparatus configured to allow a user to perform a first exercise type of a relatively lower resistance or a second exercise type of a relatively higher resistance. The exercise apparatus comprises a platform having a front roller, a rear roller and an endless belt mounted around the front roller and the rear roller. The exercise apparatus further comprises a magnetic resistance device configured to adjust the resistance of the endless belt, a frame coupled to the platform, and a restricting device coupled to the frame and configured to restrict forward motion of the user while the user is performing the first exercise type. The exercise apparatus further comprises at least one holding portion coupled to the frame and adapted to be grasped by the user while the user is performing the second exercise type. The exercise apparatus further comprises a control interface configured to control the magnetic resistance device to adjust the resistance of the endless belt.

Yet another object of the present invention provides an exercise apparatus configured to allow a user to perform a first exercise type configured to simulate moving with an attached parachute and a second exercise type configured to simulate pushing a sled. The exercise apparatus comprises a platform having a front roller, a rear roller and an endless belt mounted around the front roller and the rear roller. The exercise apparatus further comprises a magnetic resistance device configured to adjust the resistance of the endless belt, a frame coupled to the platform, and a strap coupled to the frame and configured to restrict forward motion of the user while the user is performing the first exercise type. The exercise apparatus further comprises at least one holding portion coupled to the frame and adapted to be grasped by the user while the user is performing the second exercise type. The exercise apparatus further comprises a first control interface configured to control the first exercise type and a second control interface configured to control the second exercise type.

The reader is advised that this summary is not meant to be exhaustive. Further features, aspects, and advantages of the present invention will become better understood with reference to the following description, accompanying drawings and appended claims.

Further benefits and advantages of the present invention will become apparent after a careful reading of the detailed description with appropriate reference to the accompanying drawings.

Figure 1:
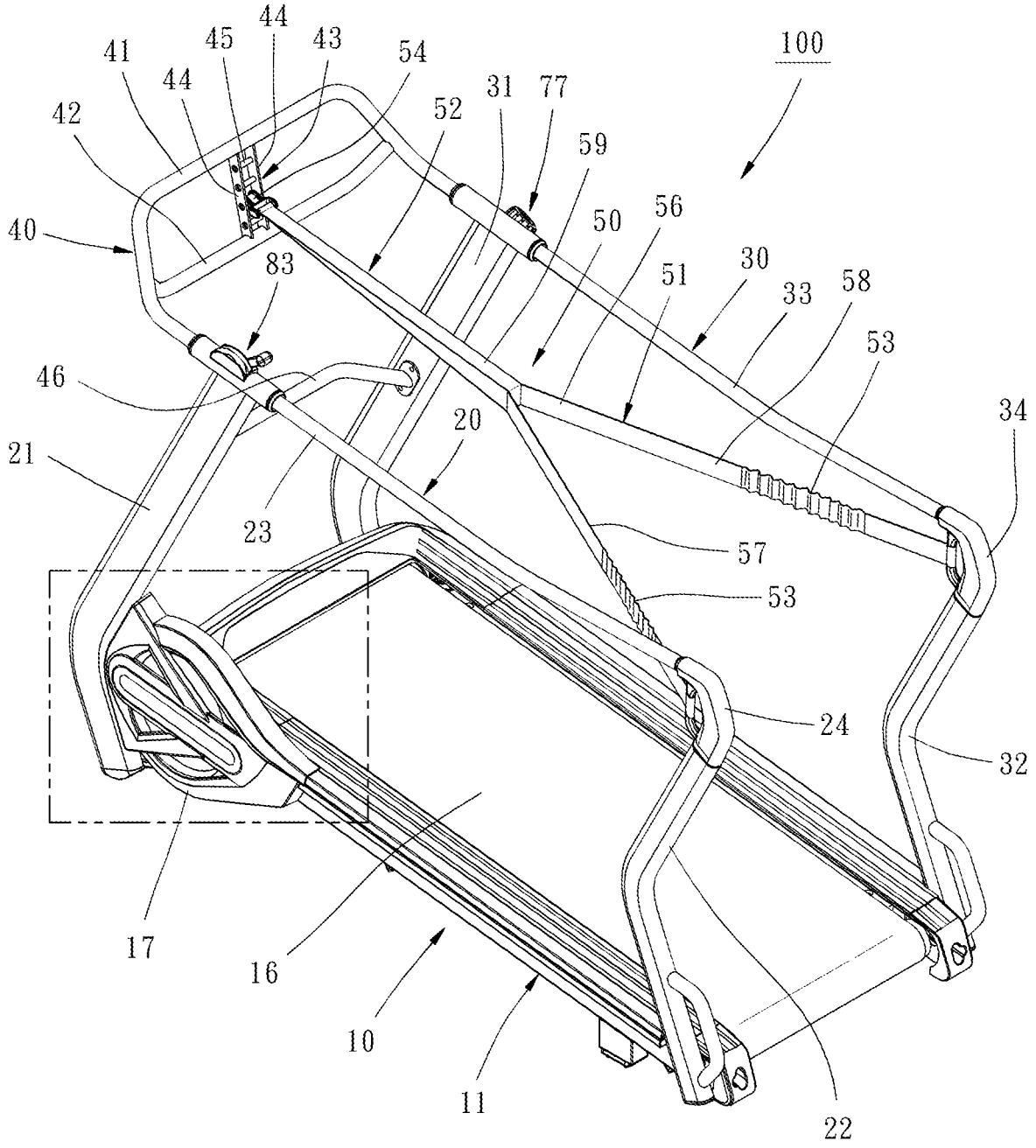
FIG. 1 is a first perspective view of an exercise apparatus in accordance with a preferred embodiment of the present invention in a first operation mode, showing an unoccupied state.

DETAIL DESCRIPTION in the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically depicted in order to simplify the drawings.

Referring to FIGS. 1 through 4, there are shown a perspective view, a front, a top view and a side sectional view of an exercise apparatus 100 in the same state according to a first preferred embodiment of the present invention. The exercise apparatus 100 includes a platform 10 resting on the ground, a left side frame 20 fixed on the left side of the platform 10, a right side frame 30 fixed on the right side of the platform 10, a front frame 40 fixed on the front end of the platform 10 and a restricting device 50 connected among the left side frame 20, the right side frame 30 and the front frame 40.

Figure 4:
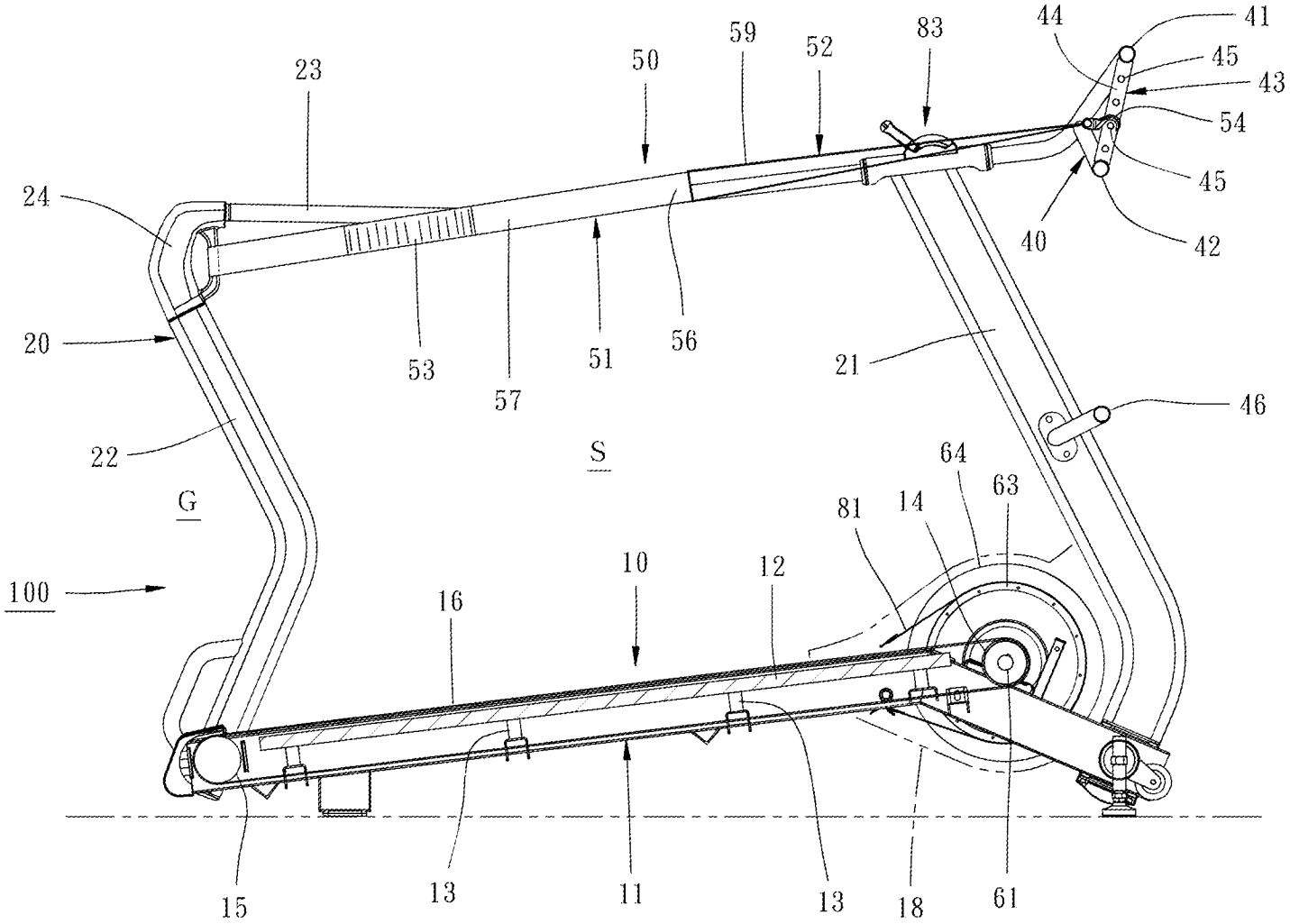
FIG. 4 is a cross-sectional view of the exercise apparatus along line IV-IV of FIG. 3, wherein parts of the outer shell are removed for showing the internal mechanism.

In the preferred embodiment of the present invention, the configuration of the platform 10 is similar to the platform of the conventional non-electric treadmill. As shown in FIG. 4, the platform 10 has a support frame 11 resting firmly on the ground. A deck 12 is supported on the support frame 11 through a plurality of elastic support members 13, wherein the front end of the deck 12 is higher than the rear end of the deck 12 (in the present embodiment, the elevation angle of the deck 12 relative to the ground is about 7 degrees). A front roller 14 is rotationally mounted on the support frame 11 in front of the deck 12 and a rear roller 15 is rotationally mounted on the support frame 11 at the rear of the deck 12. An endless belt 16 is mounted around the front roller 14 and the rear roller 15 across the top and the bottom of the deck 12 so as to provide a circular plane for a user to exercise thereon. In addition to the above common type platform, the platform of the present invention can also make use of a configuration as disclosed by the U.S. Pat. No. 8,343,016, that is, a platform without the deck. Alternatively, there are a plurality of rollers arranged along a left side and a right side of a treadmill frame in a longitudinal direction, and an endless belt comprises a plurality of parallel slates attached to each other. The left and right sides of the endless belt are available to slide on the rollers so that the endless belt could rotate around the treadmill frame and bear the user via the top plane of the belt. In short, the platform 10 is provided for allowing the user to perform walking, jogging or running on the endless belt 16, such exercises would promote the rotational motion of the belt 16. A flywheel 63 is coupled to the front roller 14. In the preferred embodiment, the flywheel 63 is coaxially mounted on the left end of the front roller 14. In addition to generate movement resistance, the inertial force produced by the rotation of the flywheel 63 also assists the revolution of the belt 16. The belt 16 defines an exercising space S above a top plane thereof (note: the space could be regard as a cuboid, the length and width of the space respectively correspond to the length and width of the top plane of the belt 16, and its height is substantially the average height of general persons). Like the exercise apparatus 100, the exercising space S defines a front side, a rear side, a left side and a right side corresponding to front, rear, left and right directions of the user.

Figure 5:
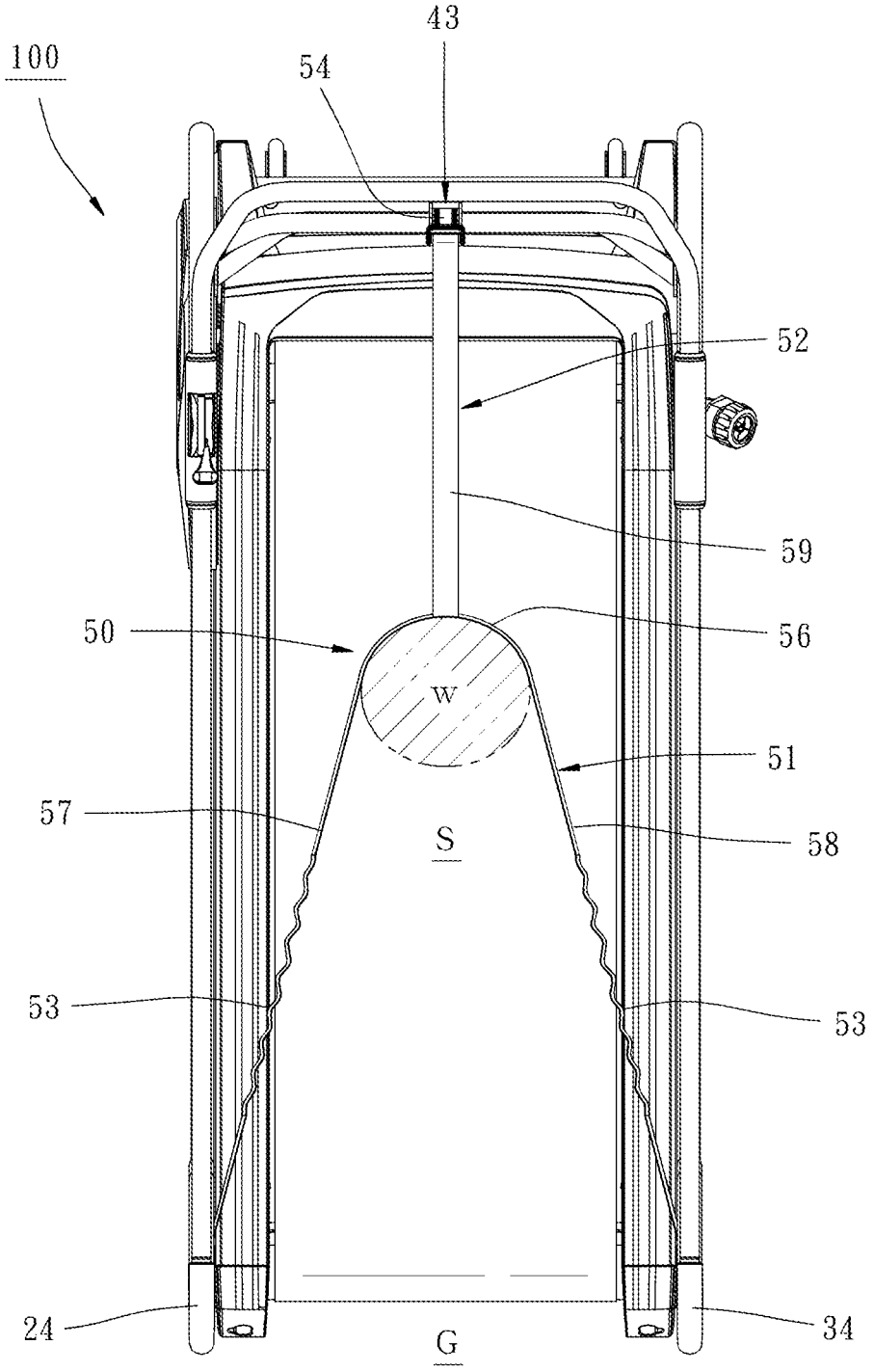
FIG. 5 is similar to FIG. 3, but illustrates a state that a user is doing running exercise.

The left side frame 20 and the right side frame 30 are respectively located at the left side and right side of the space S, and both have a front post 21, 31, a rear post 22, 32 and a handrail 23, 33. The bottom of the left and right side front posts 21, 31 are respectively secured to the left front corner and the right front corner of the support frame 11 of the platform 10. The bottom of the left and right rear posts 22, 32 are respectively secured to the left rear corner and the right rear corner of the support frame 11. The left and right side handrails 23, 33 are respectively connected between the top of the front post 21, 31 and the top of the rear post 22, 32 at the left and right sides and substantially extend parallel along the longitudinal direction of the platform 10. The height of each handrail 23, 33 (from the top plane of the belt 16) substantially corresponds to the waist height of general persons, for example 90 to 95 cm, it is available for a user to hold, if necessary. In the rear end of the exercise apparatus 100, there is an entrance G defined between the left and right rear posts 22, 32 for allowing the user to enter or exit from the exercising space S, as shown in FIGS. 4 and 5. The top end of each rear post 22, 32 and the rear end of the respective handrail 23, 33 are connected by a corner member. The corner member is configured to sustain the restricting device 50 as well. The left side corner member is defined as a left rear holding portion 24 at the left rear corner of the exercising space S, and the right side corner member is defined as a right rear holding portion 34 at the right rear corner of the exercising space S. The heights of the left rear holding portion 24 and the right rear holding portion 34 (from the top plane of the belt 16) substantially correspond to the waist height of the general persons.

The front frame 40 is connected between the top of the left and right side front posts 21, 31 and located at a front side of the exercising space S. The front frame 40 has an upper rail 41 and a lower rail 42 extending axially. A front holding portion 43 is connected between the upper rail 41 and the lower rail 42 at a central position of the front frame 40. The front holding portion 43 has two parallel longitudinal connecting plates 44 connected between the upper and lower rails 41, 42 and a plurality of horizontal rods 45 spaced apart in a distance between the two longitudinal connecting plates 44. The location of the horizontal rods 45 substantially corresponds to the waist height of the general users (from the top plane of the belt 16), wherein every adjacent two of the horizontal bars have a predetermined height difference therebetween.

The restricting device 50 includes a first strap 51 and a second strap 52. The first strap 51 defines a left end, a right end and a middle part therebetween. The left end and the right end of the first strap 51 is connected to the left rear holding portion 24 of the left side frame 20 and the right rear holding portion 34 of the right side frame 30 respectively. The middle part of the first strap 51 is located within the exercising space S and located in a central area between the left and right side frames 20, 30. The second strap 52 defines a front end connected to the front holding portion 43 of the front frame 40 and a rear end connected to the middle part of the first strap 51. Specifically, the first strap 51 comprises a plurality of tough straps (e.g. canvas bands, woven belt) sewn with elastic bands, and two ends are respectively wrapped in connection with vertical rods (not numbered) of the left rear holding portion 24 and the right rear holding portion 34 as the left and right end of the first strap 51. In addition, the first strap 51 is separated into left and right halves by the middle part, and each of the left and right halves has an elastic band 53 to form an elastic section which could be stretchable in a longitudinal direction. On the other hand, the second strap 52 is made of a tough strap. The tough strap is folded up and two ends of that are sewn together and connected to a hook 54. The hook 54 is detachably fastened on one of the horizontal rods 45 of the front holding portion 43 to form the front end of the second strap 52. The second strap 52 has the central portion of the aforementioned strap wrap around the middle part of the first strap 51 and sews together to from the rear end of the second strap 52.

Figure 2:
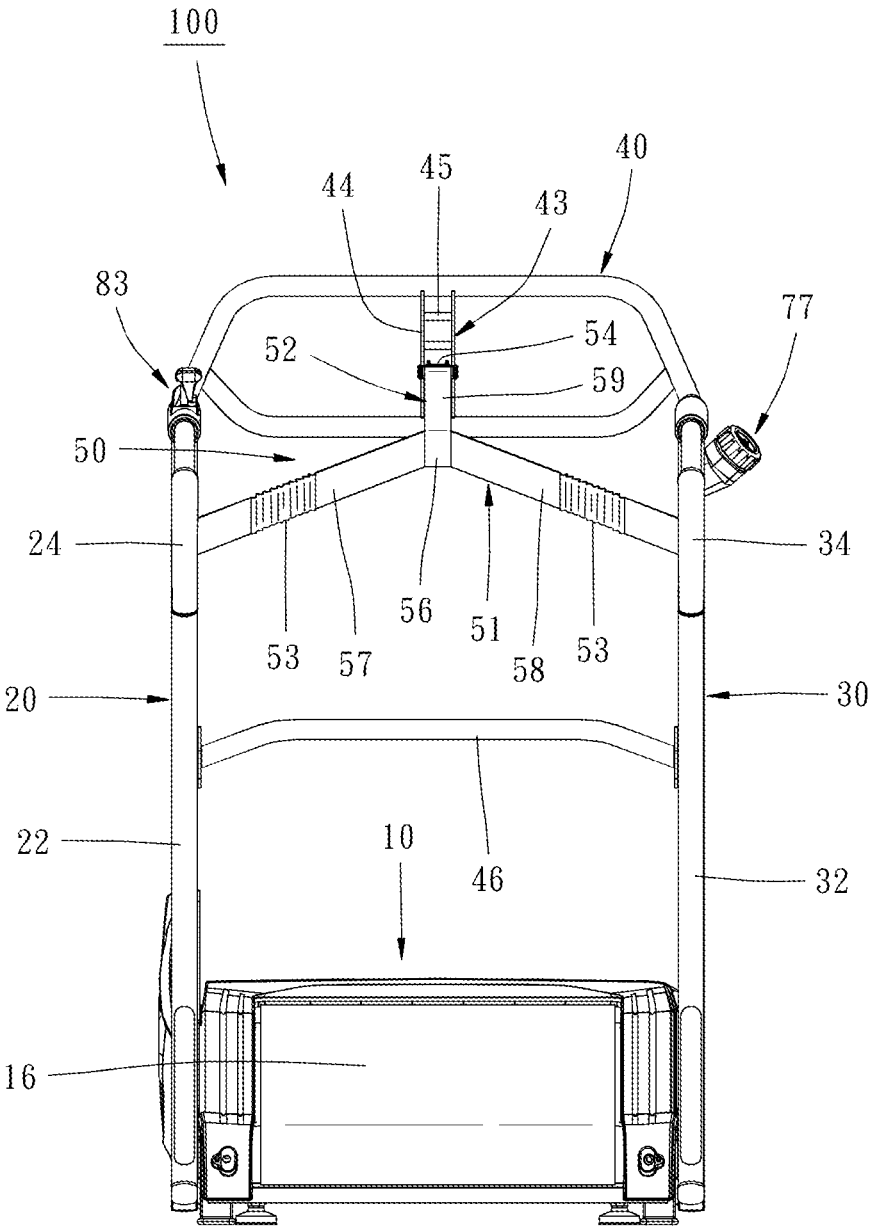
FIG. 2 is a front view of the exercise apparatus shown in FIG. 1.
Figure 3:
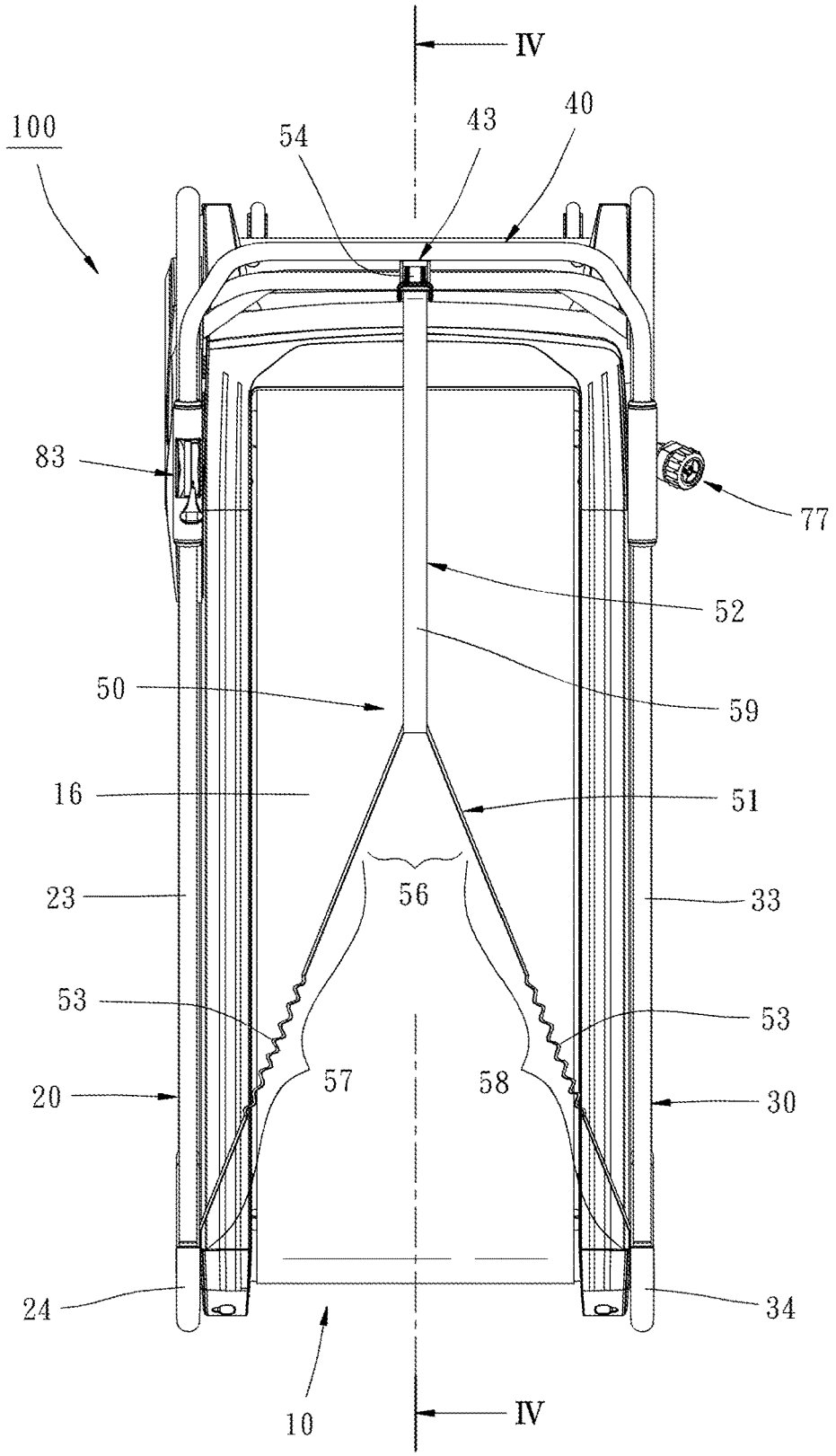
FIG. 3 is a top view of the exercise apparatus shown in FIG. 1.

As shown in FIGS. 1 through 3, the first strap 51 and the second strap 52 of the restricting device 50 is substantially Y-shaped with branch portion facing rearward (as an inverted Y shape) while the exercise apparatus 100 is unoccupied. For short, the left and right halves of the first strap 51 would be shortened by a recovery force of the elastic band 53, that is, the left half of the first strap 51 would pull the middle part toward the left rear direction and the right half of the first strap 51 would pull the middle part toward the right rear direction. Therefore, the first strap 51 will pull the rear end of the second strap 52 toward the rear direction by a symmetrical force of the left and right halves, so that the second strap 52 is stretched along the longitudinal direction. Under this arrangement, the elastic band 53 still has its elasticity, but it is unable to be shortened, thus the left and right halves of the first strap 51 are linearly extended respectively. The first strap 51 defines a local area around the middle part as a retaining portion 56 (note: the local area in FIG. 3 is schematically illustrated only, there may no clear boundary actually). The retaining portion 56 is generally V-shaped with an opening toward the rear side, it defines a left end and a right end. The first strap 51 defines a left restricting portion 57 between the left end and the retaining portion 56, showing that the left restricting portion 57 extends from left rear holding portion 24 toward a right front direction and connects to the left end of the retaining portion 56, and containing an elastic band (elastic section) 53 therebetween. The first strap 51 defines a right restricting portion 58 between the right end and the retaining portion 56, showing that the right restricting portion 58 extends from the right rear holding portion 34 toward a left front direction and connects to the right end of the retaining portion 56, and also containing an elastic band (elastic section) 53 therebetween. The whole of the second strap 52 is defined as a suspension portion 59 which extends rearward from the front holding portion 43 and connects to a central position of the retaining portion 45. All in all, the retaining portion 56 of the restricting device 50 is maintained at the central area of the exercising space S by the left restricting portion 57, the right restriction portion 58 and the suspension portion 59, and located at a corresponding height of a waist of the user.

Figure 6:
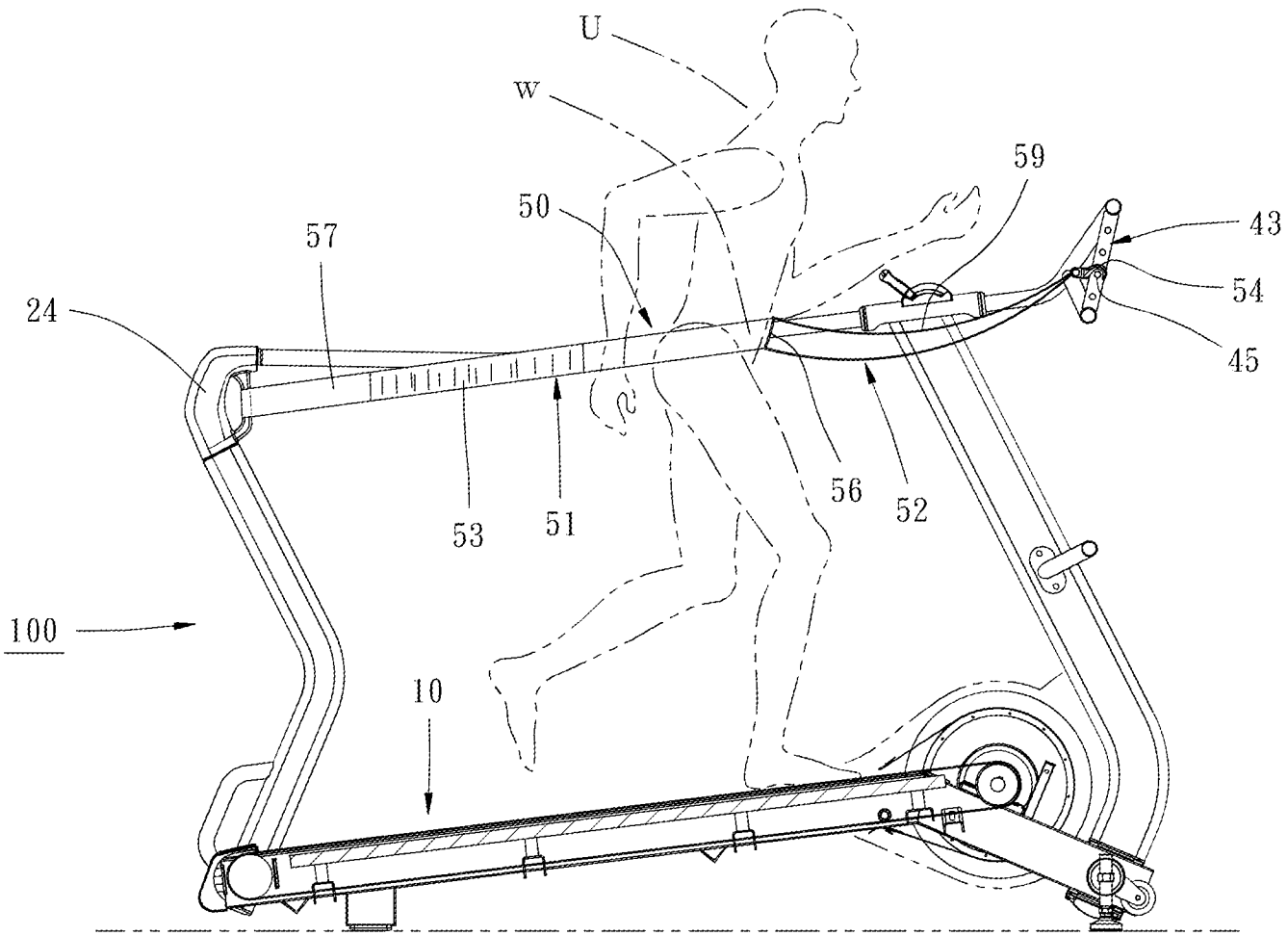
FIG. 6 is similar to FIG. 4, but illustrates the state that the user is doing running exercise.

Under this arrangement, when the user wants to perform walking, jogging or running on the exercise apparatus 100, the user can step onto the platform 10 through the entrance G at the rear end of the exercise apparatus 100 and go forward to the central area of the exercising space S freely. Generally, the retaining portion 56 of the restricting device 50 is kept at the height of the user's waist and substantially V-shaped with the opening toward the rear side. Therefore, when the user move forward to the central area of the exercising space S, the retaining portion 56 will naturally abut against the waist of the user and be deformed in accordance with the forward pressing degree of the user. For example, the retaining portion 56 would become arcuate to perfectly fit the front side, the left side and the right side of the waist of the user, and then the user could start walking, jogging or running in this state, as shown in FIG. 5 and FIG. 6. While exercising, especially at the time that the belt 16 is in the state of initial running or low speed, if the forward speed corresponding to the stepping motion of the user U is greater than the surface sliding speed of the belt 16, the user U will move forward toward the front side of the exercising space S. In other words, the retaining portion 56 of the restricting device 50 would be pushed by the waist W of the user U. Within a certain extent, the left restricting portion 57 and the right restricting portion 58 of the restricting device 50 are elongated through the elongational elasticity of the elastic band 53 till the elastic band 53 cannot be elongated anymore, and the suspension portion 59 will naturally hang down since the distance between the front and the rear end of the suspension portion 59 is shortened at the same time. Besides, the tension will increase while the elastic band 53 is elongated such that the pulling force of the left restricting portion 57 and the right restricting portion 58 for pulling the retaining portion 56 backward would be greater than the forward force of the user U, and therefore the waist W of the user U would be restricted by the retaining portion 56, thus the waist W of the user U is unable or difficult to move forward, that is, the user U cannot continue to move forward as a whole. When the waist W of the user U slightly backs from the position that the waist W of the user U is unable or difficult to move forward, the retaining portion 56 is maintained against the waist W of the user U and not falls to a low place because the retaining portion 56 is pulled by the left restricting portion 57 and the right restricting portion 58 with stretch elasticity all the time. By presetting the normal length and the maximum length of the left restricting portion 57 and the right restricting portion 58, the whole body of the user U is located in the central area or the central front location.

As the user is pulled by the rope to restrict the forward motion in the prior art, the present invention uses the restricting device 50 to retain the waist W of the user U for restricting the forward motion. In this manner, the user could run free without hands holding a front handrail, using a reaction force to increase the foot pushing force on the belt 16 for allowing the belt 16 beginning to slide easily from a rest condition and to keep running at a lower speed (in the walking motion). In addition, since the user U is unable to move forward relatively, the sliding speed of the surface of the belt 16 will fully reflect the foot motion of the user. Therefore, the user U can move naturally for walking, jogging or running just like outdoor sports and speed up or slow down the movement speed whenever they want to during the exercise. Besides, the revolution speed of the belt 16 is the speed at which the user U moves, so that the user U can continue to accelerate the running speed to sprint or quick run in the individual maximum capacity for high-strength training. When the exercise is finished, the user U is able to freely back away and leave the platform 10 through the entrance G. When the waist W of the user U is away from the retaining portion 56, the restricting device 50 will return to the original state. Compared to the prior art that the user is restricted by a rope on the rear side, in relation to the exercise apparatus 100 of the present invention, the user does not need to wear or take off the wearing member attaching to the end of the rope, it is convenient to use. Furthermore, because there is no need to set additional stationary frame for securing the rope behind the platform, the exercise apparatus 100 of the present invention occupies less space.

During the time that the user U walks, jogs or runs (including quick run or sprint) on the exercise apparatus 100, the retaining portion 56 of the restricting device 50 abuts against the front, left and right sides of the user's waist W, the left restricting portion 57 and the right restricting portion 58 respectively extend backward from the left and right sides of the user's waist W, and the suspension portion 59 extends frontward from the front side of the user's waist W, and therefore the body, two legs and two hands of the user U are not restricted and interfered by the restricting device 50 so as to move freely and naturally.

In order to improve the comfort during use, the retaining portion 56 of the restricting device 50 could affix a soft layer such as foam to an inner side thereof, and/or making the retaining portion 56 have stretch elasticity. The left restricting portion 57 and the right restricting portion 58 both use the elastic band 53 to have stretch elasticity for improving the using comfort as well. With respect to the stretch elasticity of the two restricting portions 57, 58, the elastic band 53 could be replaced by a plurality of extension springs, or making the rear ends of the two restricting portions 57, 58 connect to the respective holding portions 24, 34 via the extension springs. However, even if the left restricting portion 57 and the right restricting portion 58 have no stretch elasticity, the restricting device 50 can still accomplish the retaining function.

As shown in FIG. 6, the retaining portion 56 of the restricting device 50 is preferably attached to the waist of the user to minimize negative effects on the user. Conversely, if the position of the retaining portion 56 is too high or too low, it might interfere with the movement of the use in natural motion or let the user feel uncomfortable (for example, too high position may limit forward action of the upper body while running, and too low position may interfere with leg lifting action). For the aforementioned exercise apparatus 100, the user is able to adjust the height of the retaining portion 56 of the restricting device 50 properly according to the height of the individual waist portion or other suitable location. The user can use the hook 54 at the front end of the suspension portion 59 to hook one of the horizontal rods 45 with respect to different heights on the front holding portion 43 so that the vertical height of the retaining portion 56 could be adjusted. In another embodiment of the present invention, the rear end of the left restricting portion 57 and the rear end of the right restricting portion 58 of the restricting device 50 are available for the user to adjust height in connection with the left rear holding portion 24 and the right rear holding portion 34 respectively. In regard to height adjustment of the front end and the rear end of the restricting device 50, the ends of the restricting device 50 could be selectively connected to the holding portions 43, 24, 34 at various heights, or allowing the holding portions 43, 24, 34 to adjust its height with respect to the platform. Incidentally, the restricting device of the present invention is not limited to be extended along the level of the user's waist from the front end to the rear end. For example, in another embodiment of the present invention, the front end of the suspension portion of the restricting device is connected to the front frame at a height higher than the height of the user's waist, correspondingly, the rear ends of the left and right restricting portions are connected to the left side frame and the right side frame at a height lower than the height of the user's waist. Therefore, the retaining potion of the restricting device between the front end and the rear ends could be located at a height corresponding to the user's waist.

Figure 7:
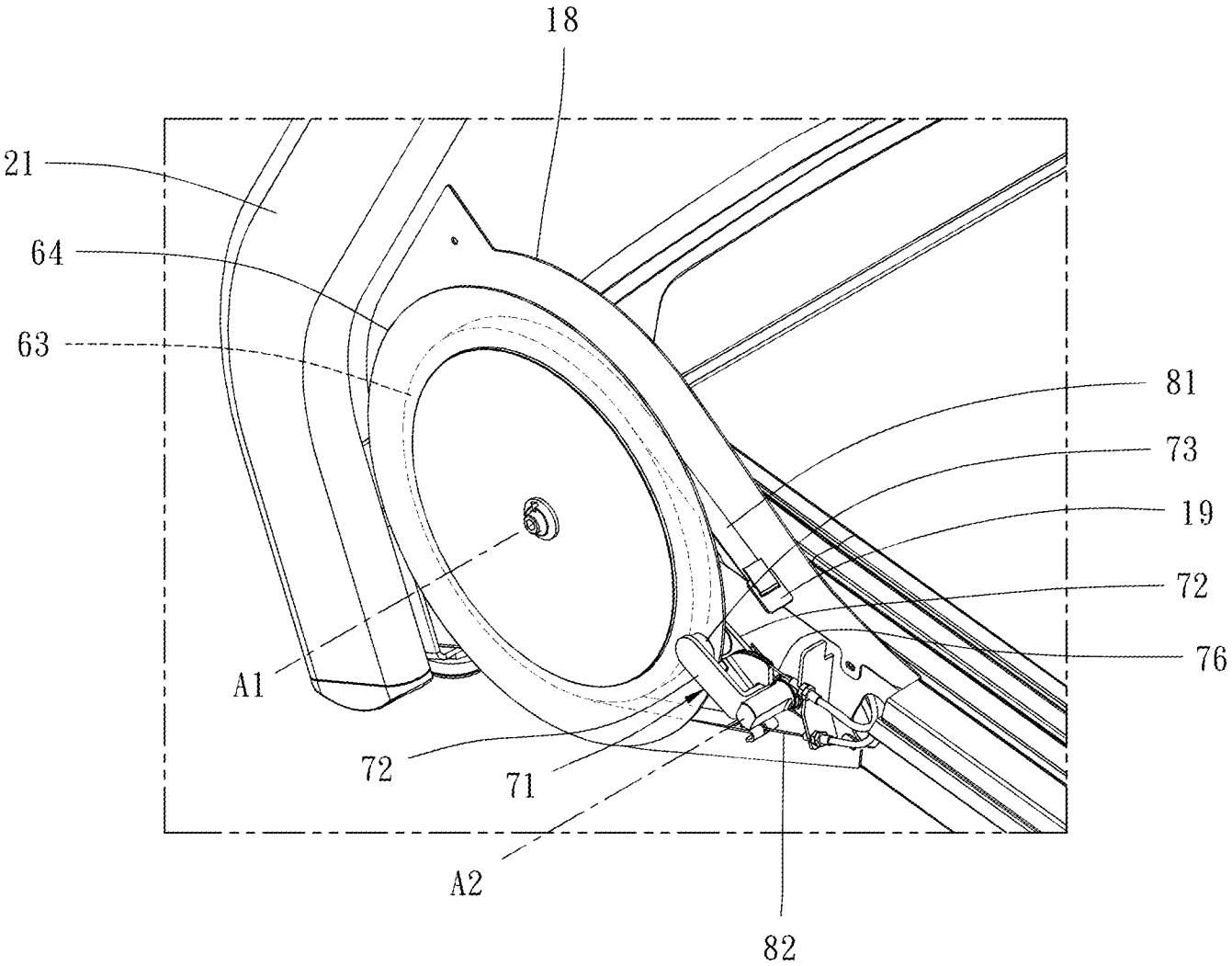
FIG. 7 is an enlarged view of a selected portion shown in FIG. 1, wherein parts of the outer shell are removed for showing the internal mechanism.
Figure 8:
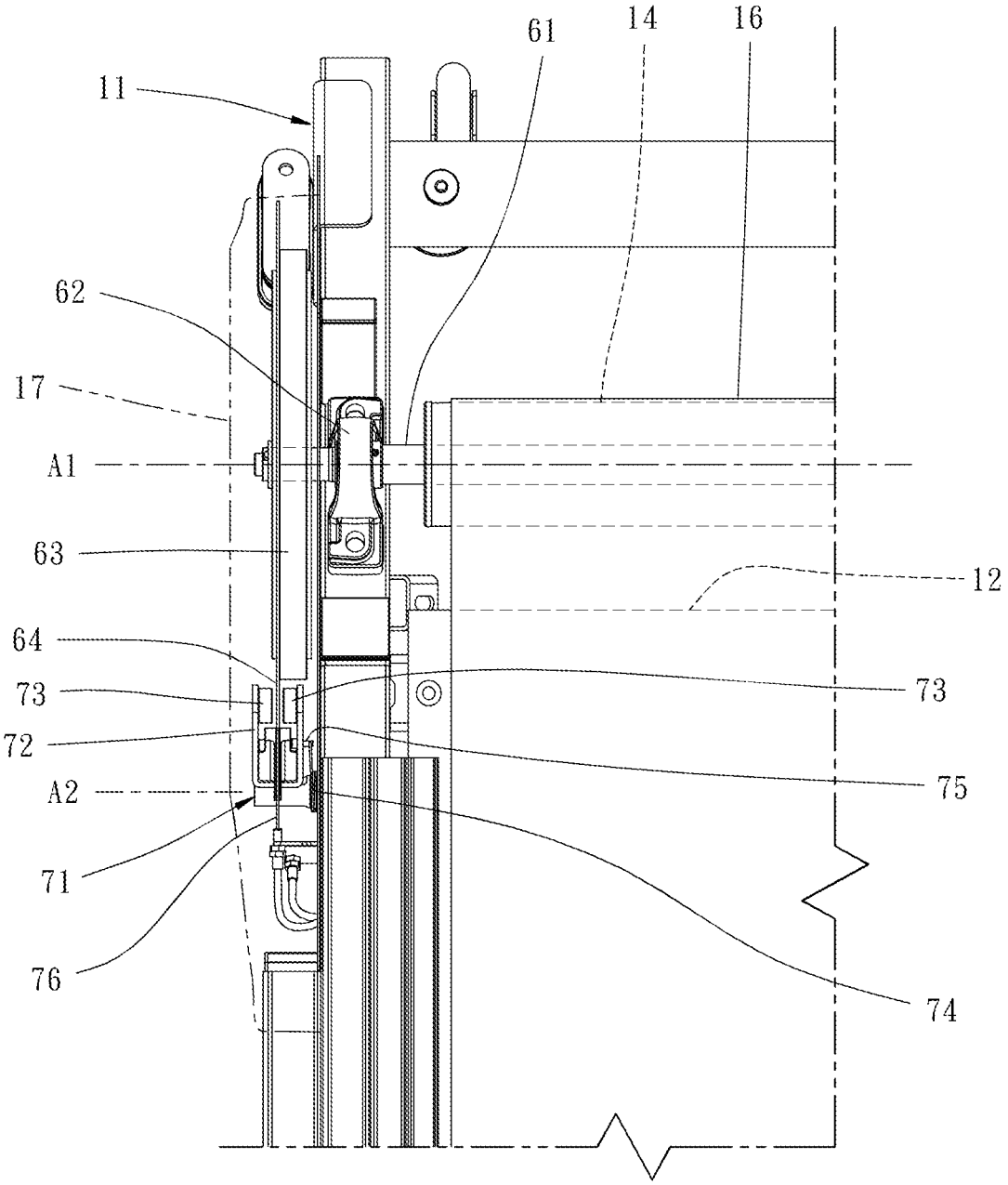
FIG. 8 is a top view for showing the left front area of the exercise apparatus in accordance with the preferred embodiment of the present invention, wherein parts of the outer shell are removed for showing the internal mechanism.

Like conventional non-electric treadmill, the exercise apparatus 100 also has a resistance device for adjusting the movement resistance of the belt 16. Referring to FIG. 4, FIG. 7 and FIG. 8, at the front end of the platform 10, the front roller 14 is coupled to a spindle 61 which passes through the axle center of the front roller 14, and two ends of the spindle 61 are pivotally mounted to the left and right sides of the support frame 11 via bearings 62, so that the front roller 14 could be in situ rotatable on the support frame 11 according to a first axis A1 in accordance with an axis of the spindle 61. The left end of the spindle 61 is projected from the respective bearing 62 and the left side of the support frame 11 and secured to the aforementioned flywheel 63. A metal disc 64 is coaxially attached to the outside of the flywheel 63. The outer diameter of the metal disc 64 is larger than that of the flywheel 63. In a back side of the flywheel 63 and the metal disc 64, a reluctance member 71 is pivotally mounted to the support frame 11 according to a second axis A2 in accordance with a lateral axial direction. The reluctance member 71 is rotatable between a first angular position and a second angular position with respect to the support frame 11 about the second axis A2. The reluctance member 71 has two parallel pivot arms 72 extended from its pivot portion and being perpendicular to the second axis A2. The two pivot arms 72 have two magnets 73 disposed at two opposite sides of the rear ends thereof. The two magnets 73 are spaced apart in a certain distance for allowing the metal disc 64 to pass through. A torsion spring 74 is mounted around the pivot portion of the reluctance member 71, as shown in FIG. 8. The torsion spring 74 has one end abutting against the support frame 11 and the other end abutting against a preset bolt 75 at an inner side of the reluctance member 71. The torsion spring 74 is configured to bias the reluctance member 71 toward the first angular position. A first steel cord 76 has one end connected to the reluctance member 71 and the other end connected to a controlling knob 77 at the top of the front post 31 of the right side frame 30. The controlling knob 77 (a conventional device, common in multi-speed bicycles) that can shorten or prolong the first steel cord 76 in stages to adjust the angle of the reluctance member 71 in stages. When the reluctance member 71 is located in the first angular position, the two magnets 73 are located at an inner side and an outer side of the metal disc 64 respectively, and an inner side of each magnet 73 faces to the metal disc 64. When the reluctance member 71 is located in the second angular position, the two magnets 73 are moved out beside the edge of the metal disc 64, and the inner side of each magnet 73 does not face the metal disc 64 substantially. Therefore, the reluctance member 71 and the metal disc 64 are defined as a magnetic resistance device, such as an eddy current brake (ECB) in the preferred embodiment of the present invention, namely, as the reluctance member 71 is controlled at various angles, the rotational resistance of the metal disc 64 (the flywheel 63, the front roller 14 as well) would be varied. For aesthetic and safety, the flywheel 63, the metal disc 64, the reluctance member 71 etc. are generally covered between a housing 17 (as shown in FIG. 1) and an inner board 18 (as shown in FIG. 7).

When the belt 16 is pushed by the user with his feet, the front roller 14 and the flywheel 63 will be rotated synchronously. The rotational inertia of the flywheel 63 provides an inertial force for the front roller 14 to make the belt 16 obtain additional pushing force and make the exercise smoother. The user could use the controlling knob 77 to adjust the rotational resistance of the metal disc 64 (and the flywheel 63, the front roller 14 as well) to make the belt 16 has a predetermined exercise resistance so as to meet requirements of walking, jogging or running exercises. For example, when the user feels that the belt 16 runs too fast/too slow, the user can turn the resistance up/down appropriately, or by increasing the resistance to enhance the exercise intensity for speeding up calorie consumption.

Figure 9:
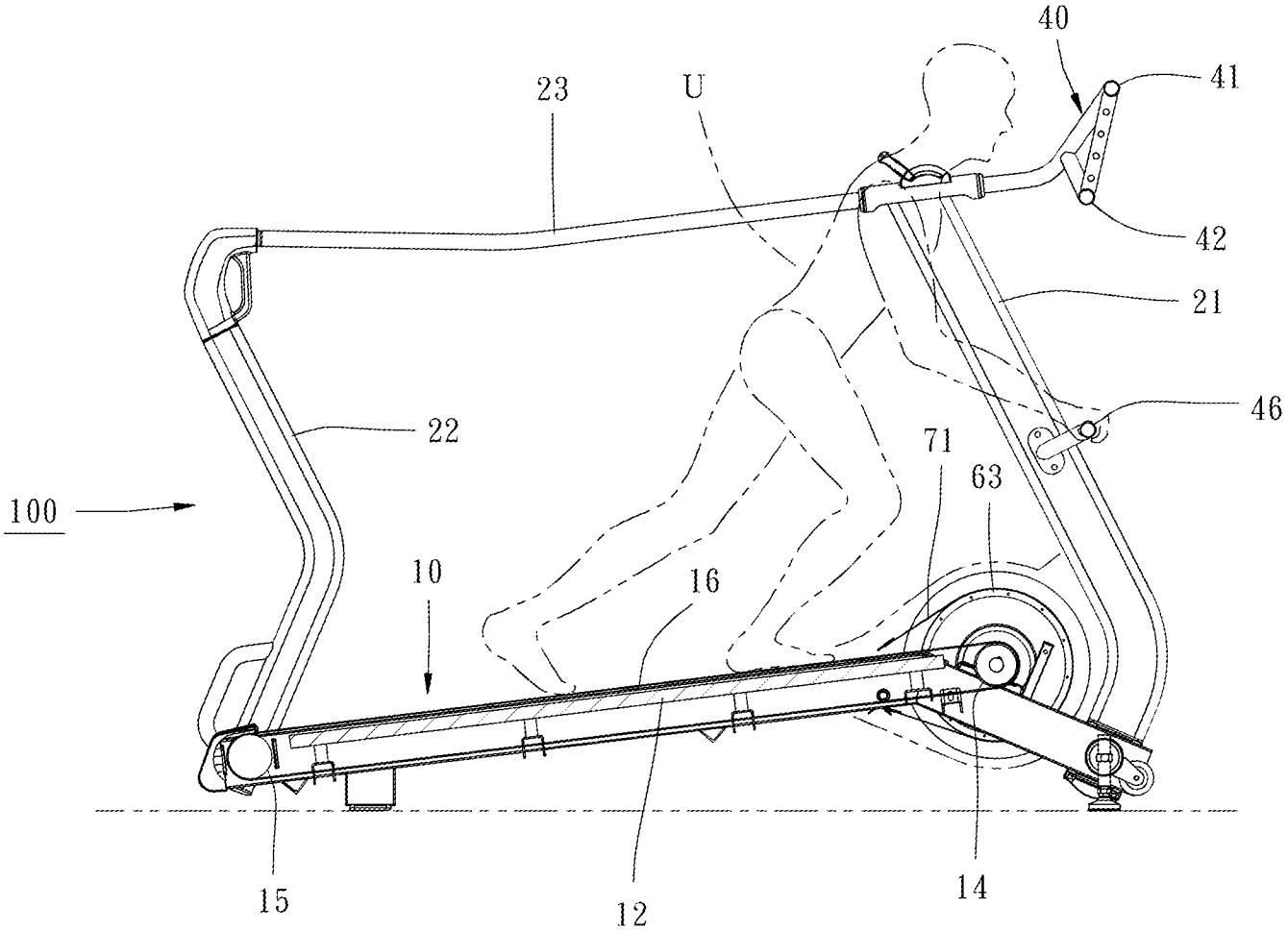
FIG. 9 is a side view of the exercise apparatus in accordance with the preferred embodiment of the present invention under a second operation mode for showing that the user executes a weight training.

As described above, the exercise apparatus 100 provides the user with aerobic exercise (or cardio exercise) of walking, jogging or running, such mode of the exercise apparatus 100 is called "first operation mode" herein. In contrast, the exercise apparatus 100 also has a "second operation mode" for allowing the user to perform a weight training (or strength training) that simulates a motion of pushing a weight forward. The related designs and methods are described below. Referring to FIG. 7, in addition to the aforementioned eddy current resistance, the flywheel 63 also has another resisting source, that is, a brake band 81 tightens concentrically around most peripheral surface of the flywheel 63. The brake band 81 has one end secured to the support frame 11 (in the present embodiment, one end of the brake band 81 is secured to a retaining plate 19 on the inner board 18) and the other end of the brake band 81 is connected to one end of a second steel cord 82. The other end of the second steel cord 82 is connected to a lever controller 83 disposed on the top of the front post 21 of the left side frame 20. The lever controller 83 (a conventional device, common in multi-speed bicycles) that can shorten or prolong the second steel cord 82 in stages to adjust tightness/looseness of the brake band 81 around the flywheel 63 in stages, namely, applying different levels of friction resistance to the flywheel 63. When the user wants to perform the foregoing weight training, the user needs to detach the restricting device 50 that is connected among the left side frame 20, the right side frame 30 and the front frame 40 such that the restricting device 50 does not occupy the exercising space S. In the present embodiment, it makes the hook 54 at the front end of the second strap 52 be detached from the front holding portion 43 of the front frame 40, and then the second strap 52, together with the first strap 51, is rested on the rear side of the exercise apparatus 100. Under the situation that the left and right ends of the first strap 51 are still connected to the left rear holding portion 24 and the right rear holding portion 34, the first strap 51 is naturally drooped in connection between the left and right rear posts 22, 32, it does not interfere with the entrance G to the platform 10 for the user. In another embodiment of the present invention, the front end of the suspension portion 59, the rear end of the left restricting portion 57 and the rear end of the right restricting portion 58 of the restricting device 50 are all available for the user to detachably connect to the front holding portion 43, the left rear holding portion 24 and the right rear holding portion 34. Thus, the front end, the left rear end and the right rear end of the restricting device 50 could be detached completely, if necessary. Then, the first strap 51 and the second strap 52 could be placed beside the exercise apparatus 100 or other suitable position. As shown in FIG. 9 (the detached first strap 51 and the second strap 52 are not shown in the drawing), in the second operation mode, the user U is located in the exercising space S of the central location or the center more to the front, with two hands holding on a suitable position of the front frame 40, e.g. the upper rail 41, the lower rail 42 or a grip rod 46 connected between the left and the right front posts 21, 31 at a central height, adopting a low center of gravity position, as shown in FIG. 9, and pushing the belt 16 with two feet of the user U so as to simulates a motion of pushing a weight forward, such as push sled.

In general, the maximum resisting force generated by the eddy current brake (ECB) is still insufficient for being the resistance of the aforementioned weight training or fails to achieve the training effect effectively. In other words, the aforementioned weight training generally requires the use of the preceding friction resistance to make the belt 16 with sufficient high resistance. Therefore, when the user is going to start the weight training, the user could ignore the setting state of the eddy current brake (ECB) and adjust the friction resistance between the brake band 81 and the flywheel 63 by the lever controller 83 to make the belt 16 with appropriate resistance that the user has to push hard. In contrast, when the user wants to start walking, jogging or running, the user generally needs to check that the friction resistance has been adjusted to a lower level or almost released first to make the belt 16 could be driven by the natural motion of walking, jogging or running. If necessary, the user could use the controlling knob 77 to adjust the eddy current resistance between the reluctance member 71 and the metal disc 64, so that the belt 16 has appropriate resistance matching with personal desired velocity or movement difficulty. Under this arrangement, the exercise apparatus 100 has an eddy current resistance device which could be adjusted independently and a friction resistance device. For the weight training, the higher resistance could be achieved mainly by the friction resistance. Besides, it can provide a very large resistance to satisfy users with excellent physical ability or requirements of high strength training, such as athletes. In contrast, while walking, jogging or running, the relatively lower resistance could be achieved mainly by the eddy current resistance for slightly adjusting the resistance easily.

Figure 10:
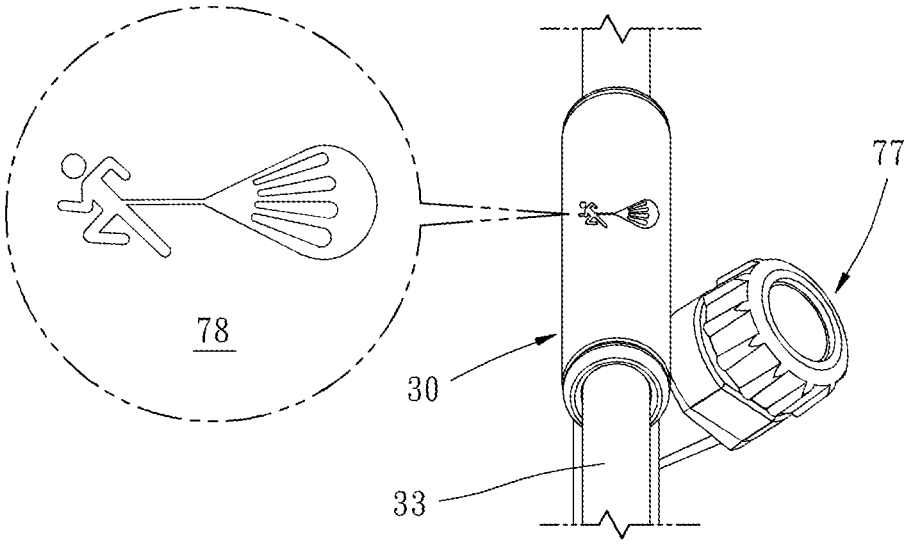
FIG. 10 shows the first control interface of the exercise apparatus in accordance with the preferred embodiment of the present invention.

In the aforementioned exercise apparatus 100, the controlling knob 77 for controlling the eddy current resistance device (or called first control interface hereafter) and the lever controller 83 for controlling the friction resistance device (or called second control interface hereafter) are respectively mounted to the right side frame 30 and the left side frame 20 and disposed at suitable locations such that the user could reach his hands to operate. Additionally, in order to enable users to identify which control interface is used to control the relatively lower resistance for performing walking, jogging or running and to identify which control interface is used to control the relative higher resistance for performing the weight training. In the preferred embodiment of the present invention, the two control interfaces 77, 83 are respectively labeled with different symbols that the user could distinguish them directly. Specifically, as shown in FIG. 10, the right side frame 30 has a first symbol 78 defined on a portion corresponding to the top of the front post 31, namely the first symbol 78 is arranged beside the controlling knob 77. The first symbol 78 is displayed on the right side frame 30 by means of coating printing, stamping, stickers, dual-color injection, embossing, intaglio, etc. The first symbol 78 represents a figure with a running person dragging a parachute behind him, which symbolizes that the user must overcome a relatively lower resistance while performing walking, jogging or running (or called first type exercises hereafter). On the other hand, as shown in FIG. 1, the lever controller 83 has a second symbol 84 defined on a top plane of a lever thereof by means of coating printing, stamping, stickers, dual-color injection, embossing, intaglio, etc. The second symbol 84 represents a figure with a person reached his hands to push a weight (exaggerative) forwards, which symbolizes that the user must overcome a relative higher resistance while performing the weight training (or called second type exercises hereafter). The first symbol 78 shows an identifiable human figure corresponding to an exercise posture as performing the first type exercise (represented by the running posture), and the second symbol 84 shows another identifiable human figure corresponding to another exercise posture as performing the second type exercise. In the meanwhile, the images of the parachute and the weight (exaggerative) matched with the human postures would make people associate the first type exercise with the relatively lower resistance and associate the second type exercise with the relative higher resistance. Therefore, under the first control interface 77 and the second control interface 83 respectively labeled with the first symbol 78 and the second symbol 84, the user is able to quickly and correctly identify the respective purposes of the two control interfaces 77, 83. In other words, no matter the user is performing the first type exercise of walking, jogging or running under the first operation mode, or is performing the second type exercise of simulating a training of pushing a weight forward under the second operation mode, the user could operate the correct control interface 77, 83 directly and adjust the required resistance of the endless belt for the exercise at the time.

Figure 11:
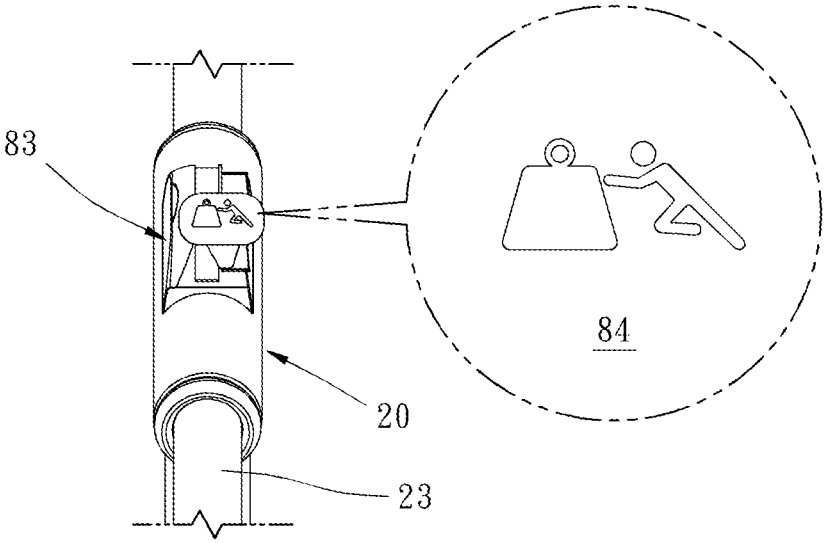
FIG. 11 shows the second control interface of the exercise apparatus in accordance with the preferred embodiment of the present invention.
Figure 10A:
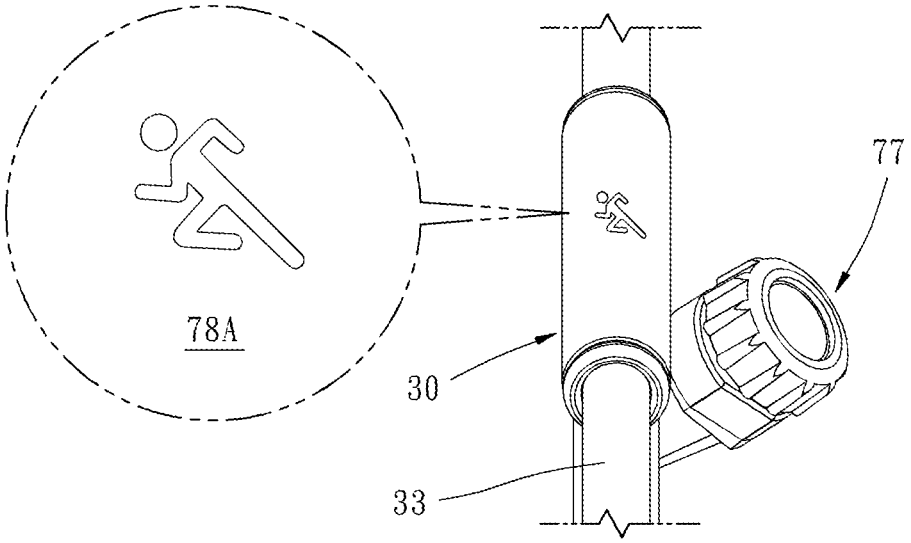
FIG. 10A is similar to FIG. 10, showing the first control interface with different illustration.
Figure 11A:
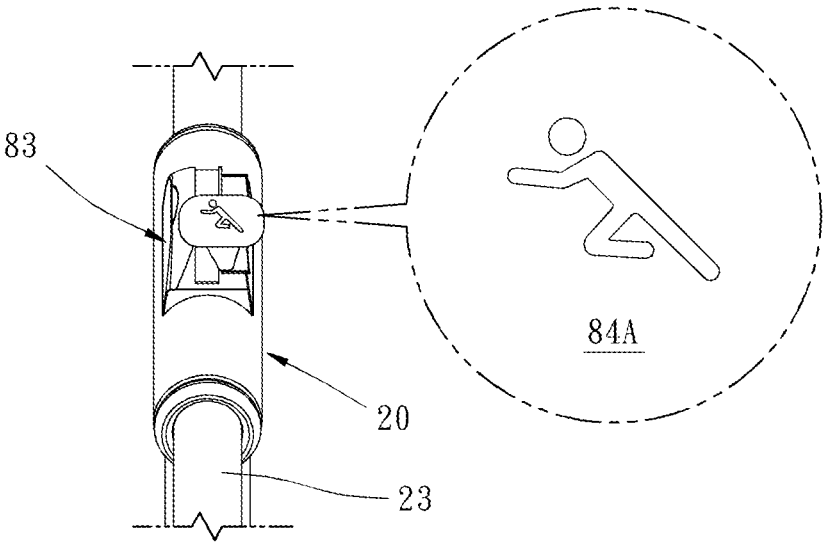
FIG. 11A and FIG. 11B are similar to FIG. 11, showing the second control interface with different illustration.

FIG. 10A and FIG. 11A illustrate another embodiment of the present invention, which respectively show the more simple expressions of the first symbol and the second symbol, that is the first symbol 78A only has a posture as a human figure for performing the first type exercise (represented by the running posture), and the second symbol 84A only has another posture as a human figure for performing the second type exercise. It allows the user to identify the respective purposes of the first control interface 77 and the second control interface 83.

In actual operation conditions, if the lever of the lever controller 83 is pushed to the more forward position, the second steel cord 82 connected between the lever controller 83 and the brake band 81 of the friction resistance device would be tightened simultaneously so as to make the friction resistance device apply more drag force to the flywheel 63. On the contrary, if the lever of the lever controller 83 is pulled to the more backward position, the friction resistance device would apply less drag force to the flywheel 63 (this is a general application of a conventional device, and the technical details are omitted). The lever controller 83 shown in FIGS. 11 and 11A has a plurality of scale marks spaced a distance apart on the arc path with respect to the adjustable range of the lever and a plurality of numerals corresponding to the scales (not shown). The numerals are increased progressively from back to front along the adjusting path of the lever so as to indicate the corresponding resistance level according to the location of the lever. For example, in the present embodiment, the friction resistance can be adjusted by the lever controller 83 with eight adjustments. Thus the rearmost scale mark of the adjusting path of the lever is labeled "1", the forward scale mark is labeled "2", and so on, and the foremost scale mark is labeled "8". In contrast, the eddy current resistance can be adjusted by the controlling knob 77 with eleven adjustments. The controlling knob 77 shown in FIGS. 10 and 10A is labeled "1" to "11" spaced a distance apart on the periphery of the controlling knob 77 (not shown). When the controlling knob 77 is turned to a specific angle within the adjustable range, a specific numeral on the periphery of the controlling knob 77 is aligned with a reference symbol (not shown) on a base for indicating the corresponding resistance level according to the angular position of the controlling knob 77.

Figure 10B:
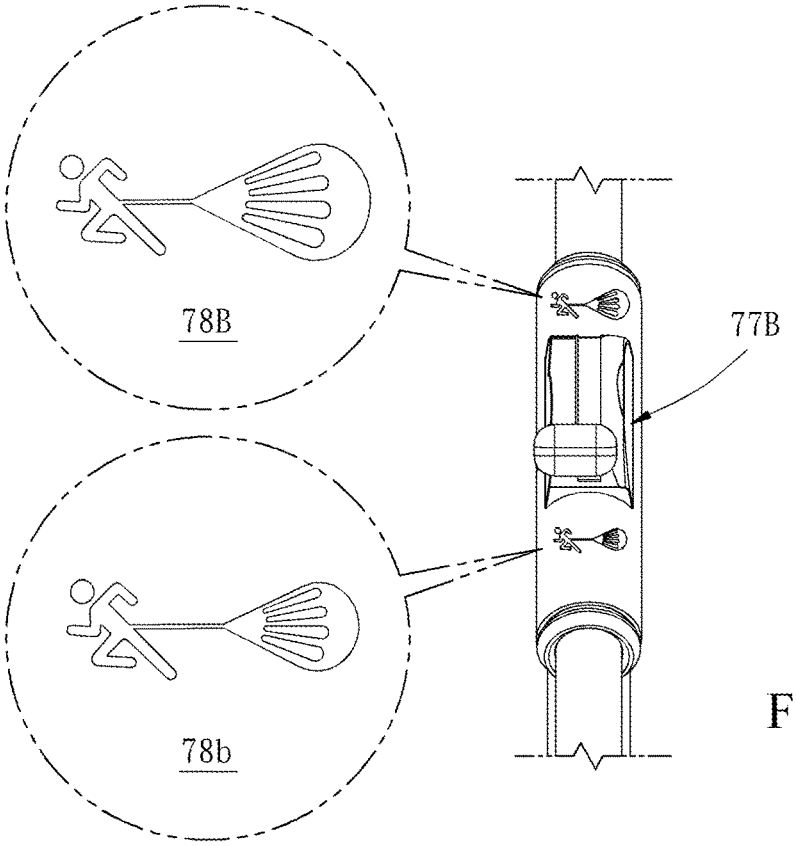
FIG. 10B illustrates another embodiment of the first control interface.
Figure 11B:
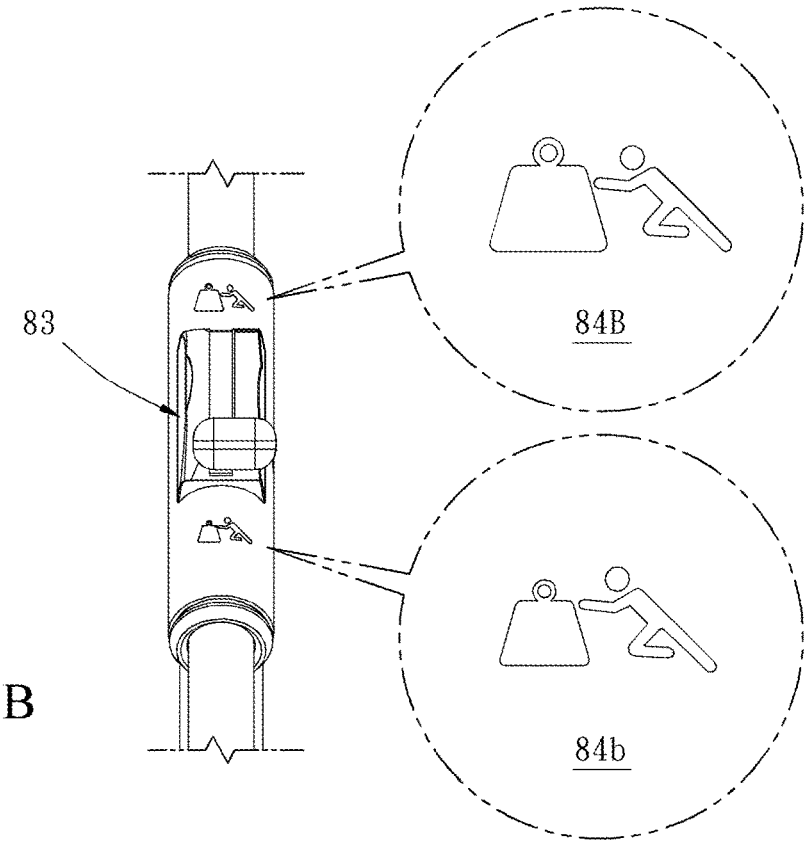

FIG. 11B shows that the lever controller (the second control interface) 83 adopts another representing way, namely, in this embodiment, the left side frame 20 is labeled with two second symbols 84B, 84*b* respectively defined at the front position and the rear position with respect to the lever controller 83. Both the two second symbols 84B, 84*b* resemble the second symbol 84 shown in FIG. 11, representing a figure with a person reached his hands to push a weight forward. It is noteworthy that the weight figure of the second symbol 84B at the front position (corresponding to the direction of increasing the drag force) is relatively large, representing a greater resistance. In contrast, the other weight figure of the second symbol 84*b* at the rear position (corresponding to the direction of decreasing the drag force) is relatively small, representing a lower resistance. Base on the same technical idea, as shown in FIG. 10B, the first control interface is able to adopt another lever controller 77B as well, and is labeled two first symbols 78B, 78*b* respectively defined at the front position and the rear position with respect to the lever controller 77B. Both the two first symbols 78B, 78*b* represent a figure with a running person dragging a parachute. The parachute figure of the first symbol 78B at the front position is relatively large, representing a greater resistance. In contrast, the other parachute figure of the first symbol 78*b* at the rear position is relatively small, representing a lower resistance. Of course, the same technical idea is applicable to a controlling knob or any other controlling device with two opposite operational direction. With a controlling knob as an example, it can be labeled a relatively large parachute/weight figure corresponding to a rotational direction of increasing the drag force (as 78B, 84B), and be labeled a relative small parachute/weight figure corresponding to a rotational direction of decreasing the drag force (as 78*b*, 84*b*). Under this representation, the user could not only directly identify the respective purposes of the first control interface and the second control interface, but also directly identify operating directions of increasing or decreasing the drag force in the same control interface so as to enhance the friendliness of the control interface and to reduce operating errors.

Although the control interfaces of the aforementioned embodiments are designed to control the resistance device with purely mechanical means, it could also be achieved by electronic circuits and electronic control means. For instance, in another embodiment of the present invention (not shown), the reluctance member 71 of the eddy current resistance device could be modified to be driven by an electronic motor to control its deflection angle. Correspondingly, the first control interface is replaced by an electronic control panel electronically connected to the electronic motor, having two opposite pressed keys for allowing the user to operate to increase or decrease the drag force (note: this is a general application of a conventional device, and the technical details are omitted). According to the technical idea disclosed in the preceding section, the first control interface could be labeled the FIGS. 78B, 78*b* as shown in FIG. 10B on the two pressed keys or beside them for the user to identification.

According to one aspect of the present invention, the exercise apparatus provides two operation modes for allowing the user to choose to perform the first type exercise (such as walking, jogging or running mentioned before) under the first operation mode, or choose to perform the second type exercise (such as simulating the training of pushing a weight forward mentioned before) under the second operation mode. The exercising movements of the first type exercise and the second type exercise differ from each other. The exercise apparatus comprises a frame, and a moving member (e.g. the aforementioned flywheel 63) movably mounted to the frame. The first type exercise and the second type exercise shall power the moving member. A first resistance device (e.g. a contactless resistance device, such as the aforementioned eddy current resistance device) is controllable to apply a first drag force to the moving member. A second type resistance device (e.g. a contact resistance device, such as the aforementioned friction resistance device) is controllable to apply a second drag force to the moving member. The second drag force generated by the second resistance device is higher than the first drag force generated by the first resistance device. A first control interface is connected to the first resistance device, for allowing the user to manually control the first resistance device to increase or decrease the first drag force applied to the moving member. The first control interface has at least one first symbol including a human figure showing a posture as performing the first type exercise. And a second control interface is connected to the second resistance device, for allowing the user to manually control the second resistance device to increase or decrease the second drag force applied to the moving member. The second control interface has at least one second symbol including a human figure showing a posture as performing the second type exercise. Specifically, the resistance of the moving member for performing the second type exercise is higher than the resistance for performing the first type exercise.

Under this arrangement, the exercise apparatus provide a choice for the user to choose one aerobic exercise such as walking, jogging running, or simulating weigh training for pushing a weight forward. Moreover, it could easily obtain appropriate resistance whether performing the aerobic exercise or the weight training. The exercise apparatus of the present invention includes: a platform having a front roller, a rear roller and an endless belt mounted around above two rollers for allowing the user to perform walking, jogging or running on the belt, such exercises would make the belt be revolved; a flywheel coaxially connected to the front roller. A friction resistance device is coupled to the flywheel for allowing the user to manually control the rotational resistance of the flywheel and the front roller. An eddy current resistance device is coupled to the flywheel for allowing the user to manually control the rotational resistance of the flywheel and the front roller. A front frame mounted on a front end of the platform, and having at least one holding portion for the user to grasp.

Figure 12:
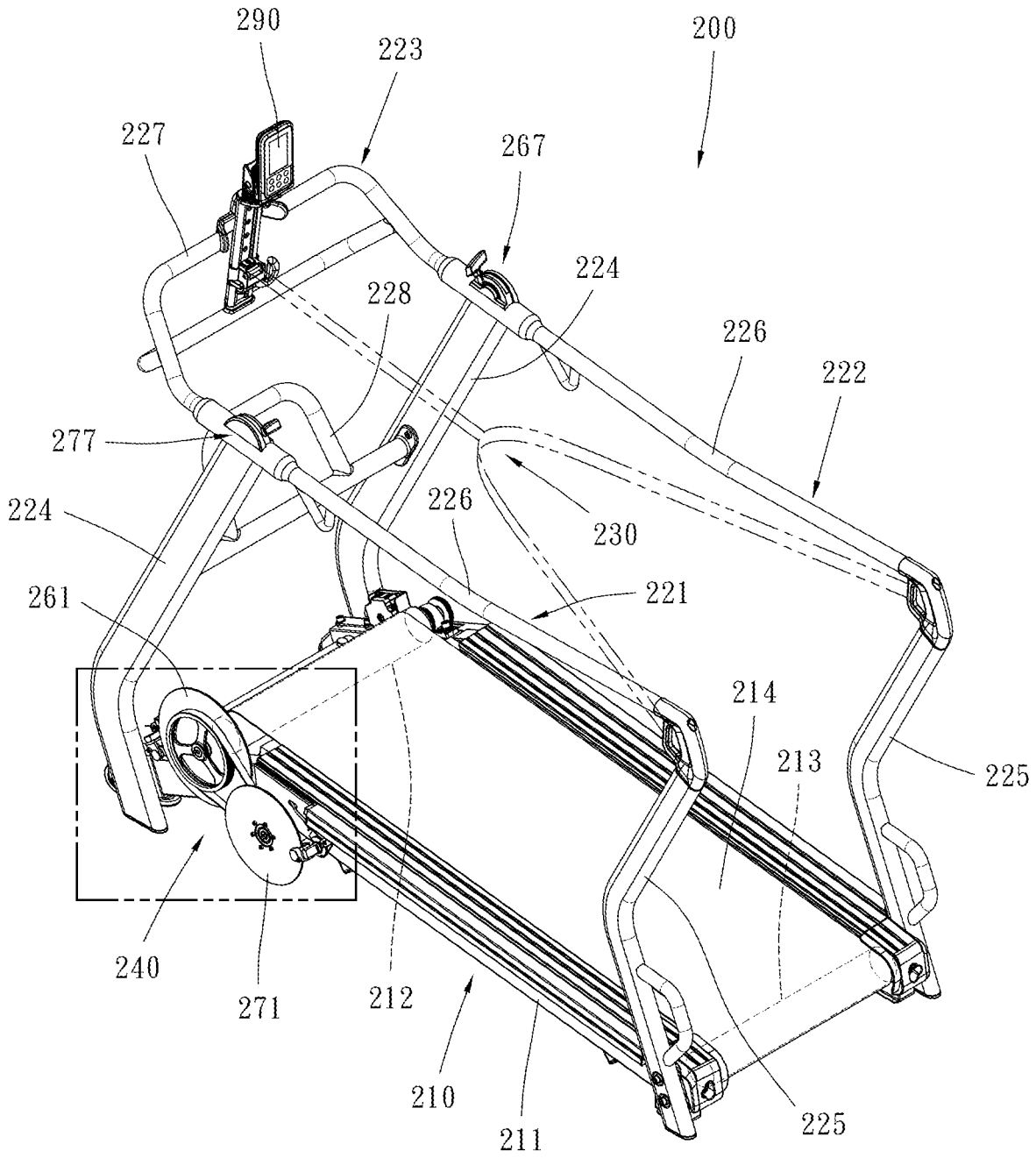
FIG. 12 is a perspective view of an exercise apparatus in accordance with a second preferred embodiment of the present invention.
Figure 13:
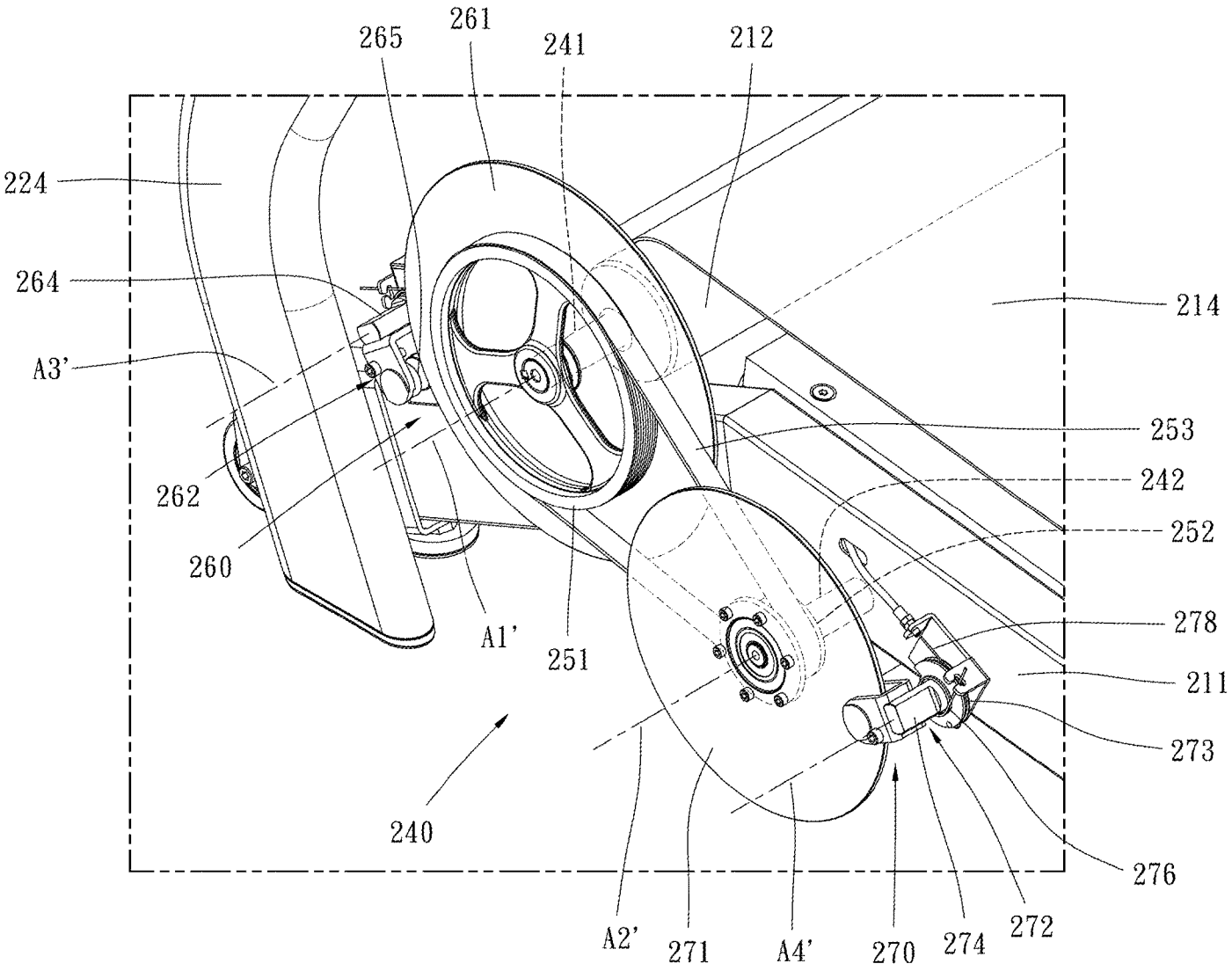
FIG. 13 is an enlarged view of a selected portion shown in FIG. 12 for presenting the resistance system of the exercise apparatus.

Referring to FIG. 12, an exercise apparatus 200 in accordance with a second preferred embodiment is described below. The second embodiment is similar to the first embodiment of the present invention except the resistance device. The exercise apparatus 200 includes a platform 210 resting on the ground, a left side frame 221, a right side frame 222, a front side frame 223, a restricting device 230 connected among the above frames 221, 222, 223, and a resistance system 240 mounted on the left side of the front end of the platform 210. Similarly, the exercise apparatus 200 is also provided for allowing the user choose to perform aerobic exercise (or cardio exercise) of walking, jogging or running under a first operation mode, or choose to perform weight training (or strength training) for simulating a workout of pushing a weight forward under a second operation mode. The aforementioned resistance system 240 is used to provide desired exercise resistance during the aerobic exercise or weight training. The exercise apparatus 200 of the second embodiment of the present invention improves the resistance device of the exercise apparatus 100 of the first embodiment.

The platform 210 has a support frame 211 resting firmly on the ground, a front roller 212 rotationally mounted on the front end of the support frame 211, a rear roller 213 rotationally mounted on the rear end of the support frame 211, and an endless belt 214 mounted around the front roller 212 and the rear roller 213. The aforementioned platform 210 does not have a power device such as motor, and is mainly driven by the force of the foot when the user pushes the endless belt 214 with two feet.

The left side frame 221 and the right side frame 222 both have a front post 224 extending upward from the front end of the support frame 211, a rear post 225 extending upward from the rear end of the support frame 211, and a handrail 226 connected between the top of the front post 224 and the top of the rear post 225. The front side frame 223 is connected between the left and right front, post 224, and at various height positions, there are a plurality of grip portions 227, 228 for allowing the user to selectively grasp. The aforementioned support frame 211, left side frame 221, right side frame 222 and front side frame 223 together constitute a frame assembly of the exercise apparatus 200.

The restricting device 230 is a substantially Y-shaped strap. When the exercise apparatus 200 is operated in the first operation mode for allowing the user to perform walking, jogging or running, the restricting device 230 is equipped among the left side frame 221, the right side frame 222 and the front side frame 223, as shown in FIG. 12, and is suspended above the endless belt 214 at a suitable height for retaining the waist of the user to restrict the forward motion, so that the user can push the endless belt 214 backward without holding any frame, and therefore the user is able to perform walking, jogging or running freely and naturally. When the exercise apparatus 200 is operated in the second operation mode for allowing the user to perform weight training, the restricting device 230 is detached from the exercise apparatus 200, so that the user is able to grasp the grip portion 227/228 of the front side frame 223 and push the endless belt 214 backward with two feet so as to simulate a training of pushing a weight forward on the ground.

In the second embodiment of the present invention, the endless belt 214 is regarded as a moving member that is configured for contacting the user who performs exercise on the exercise apparatus 200. When the user performs the exercise, the moving member is driven by movement of the user to move with respect to the frame assembly (e.g. rotational motion in the present embodiment). The resistance system 240 is controllable to apply a resistance against rotation of the endless belt 214. For example, a relatively light resistance is generated in the first operation mode, and a relatively large resistance is generated in the second operation mode.

Referring to FIG. 13 through FIG. 16, the resistance system 240 is disposed on the left side of the front end of the platform 210, which mainly comprises a first rotating shaft 241 and a second rotating shaft 242 rotationally mounted to the support frame 211, a transmission mechanism connected between the first rotating shaft 241 and the second rotating shaft 242, a first resistance device 260 for resisting rotation of the first rotating shaft 241, and a second resistance device 270 for resisting rotation of the second rotating shaft 242.

As mentioned before, the front roller 212 is mounted on the front end of the support frame 211, and two ends of the front roller 212 are respectively rotationally mounted on the left and right sides of the front end of the support frame 211 via bearings 215, so that the front roller 212 could be rotatable on the support frame 211 according to a first axis A1' namely the central axis of the front roller 212. The first rotating shaft 241 of the resistance system 240 is coaxially fixed to the left end of the front roller 212 so as to be rotatable according to the first axis A1'. Since the endless belt 214 is mounted around the front roller 212 and the rear roller 213 with a suitable tightness, the front roller 212 and the rear roller 213 are rotated correspondingly when the endless belt 214 is moved. On the other hand, the rotation of the front roller 212 and the rear roller 213 also drives the endless belt 214 to move correspondingly. In practice, the rotational inertia of the front roller 212 and rear roller 213 will become an inertial force to assist the revolution of the endless belt 214. Since the first rotating shaft 241 is coaxially fixed to the front roller 212 and rotated synchronously, the first rotating shaft 241 is deemed to be coupled to the endless belt 214 via the front roller 212. When the user drives the endless belt 214 to move, it will also drive the first rotating shaft 241 to rotate correspondingly. The second rotating shaft 242 is parallel to the first rotating shaft 241 and located next to the first rotating shaft 241. The second rotating shaft 242 is rotationally mounted to the support frame 211 according to a second axis A2', namely the second rotating shaft 242 is rotatable about the second axis A2' with respect to the support frame 211.

Figure 16:
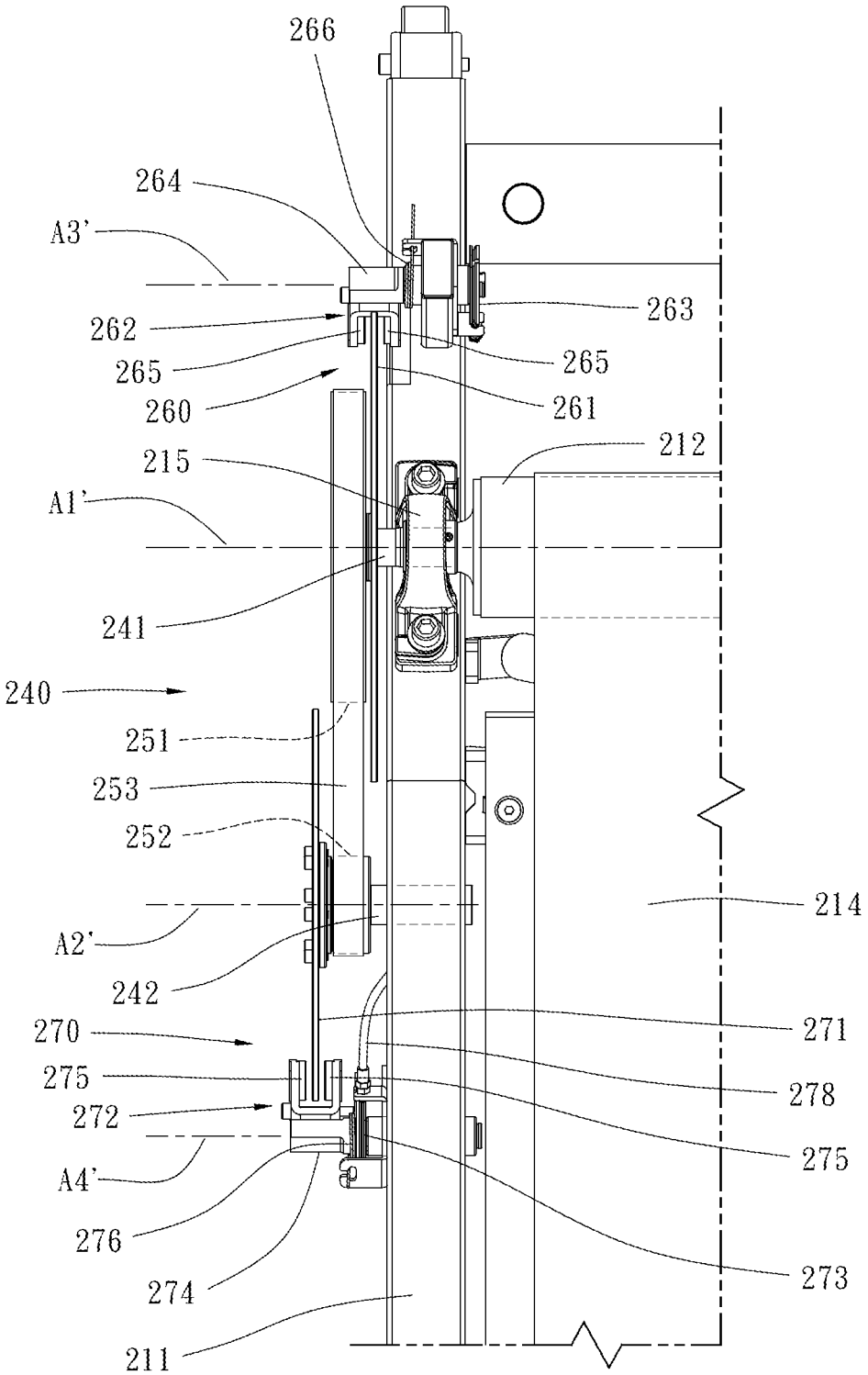
FIG. 16 is a top view of the resistance system shown in FIG. 13.

The transmission mechanism is formed by a first transmission wheel 251, a second transmission wheel 252 and a transmission belt 253. The first transmission wheel 251 is specifically a large pulley with a relatively large diameter, which is coaxially fixed to the outer end of the first rotating shaft 241. The second transmission wheel 252 is specifically a small pulley with a relative small diameter, which is coaxially fixed to the outer end of the second rotating shaft 242. The first transmission wheel 251 is aligned with the second transmission wheel 252 as shown in FIG. 16. The transmission belt 253 is mounted around the first transmission wheel 251 and the second transmission wheel 252 with a suitable tightness, so that the first transmission wheel 251 and the second transmission wheel 252 are rotated relative to each other at a predetermined transmission ratio, namely the first rotating shaft 241 and the second rotating shaft 242 are rotated relative to each other at a predetermined transmission ratio. In the preferred embodiment, the diameter/circumference of the first transmission wheel 251 is about 3.2 times greater than the diameter/circumference of the second transmission wheel 252, such that the second rotating shaft 242 is rotated about 3.2 turns as the first rotating shaft 241 is rotated for one turn. In other words, the rotational speed of the second rotating shaft 242 is about 3.2 times greater than the rotational speed of the first rotating shaft 241, or the aforementioned transmission ratio is about 3.2. Therefore, when the endless belt 214 is driven by the user, the first rotating shaft 241 and the second rotating shaft 242 are driven to rotate at different rotational speed. Specifically, the second rotating shaft 242 is coupled to the endless belt 214 via the transmission mechanism, the first rotating shaft 241 and the front roller 212, and the first rotating shaft 241 is coupled to the endless belt 214 without the transmission mechanism.

In the preferred embodiment, the first transmission wheel 251 (large pulley) on the first rotating shaft 241 is made of heavier metal for generating a relatively greater rotational inertia during rotation, such that the first transmission wheel 251 can function as a flywheel for smoothing the rotation of the front roller 212 and the revolution of the endless belt 214, especially when the exercise apparatus is provided for performing running exercise.

In addition to the above structure, the transmission mechanism may adopt other structure for transmission. For example, the transmission wheel and the transmission belt may use timing wheel and timing belt respectively, or replaced by chain wheel and chain, or achieved by a large gear and a small gear which are mashed with each other to accelerate transmission. Besides, the transmission mechanism is not limited to adopt single stage transmission, namely the transmission mechanism may adopt two stage transmission, three stage transmission, etc. For example, an intermediate rotating shaft may be provided between the first rotating shaft and the second rotating shaft. The intermediate rotating shaft is coaxially mounted with a smaller diameter third transmission wheel and a larger diameter fourth transmission wheel. The diameter of the third transmission wheel is smaller than the diameter of the first transmission wheel which is mounted on the first rotating shaft and a first transmission belt is mounted around them. The diameter of the fourth transmission wheel is larger than the diameter of the second transmission wheel and a second transmission belt is mounted around them. Accordingly, the rotational speed of the intermediate rotating shaft is faster than the rotational speed of the first rotating shaft, namely the first accelerate transmission; and the rotational speed of the second rotating shaft is faster than the rotational speed of the intermediate rotating shaft, namely the second accelerate transmission, and therefore achieve a higher transmission ratio. In view of the purpose of the present invention, the transmission ratio of the transmission mechanism is at least 2 (namely the rotational speed of the faster one of the first and second rotating shafts is at least twice as fast as the rotational speed of the slower one of the two rotating shafts), and preferably 3 or more.

Figure 15:
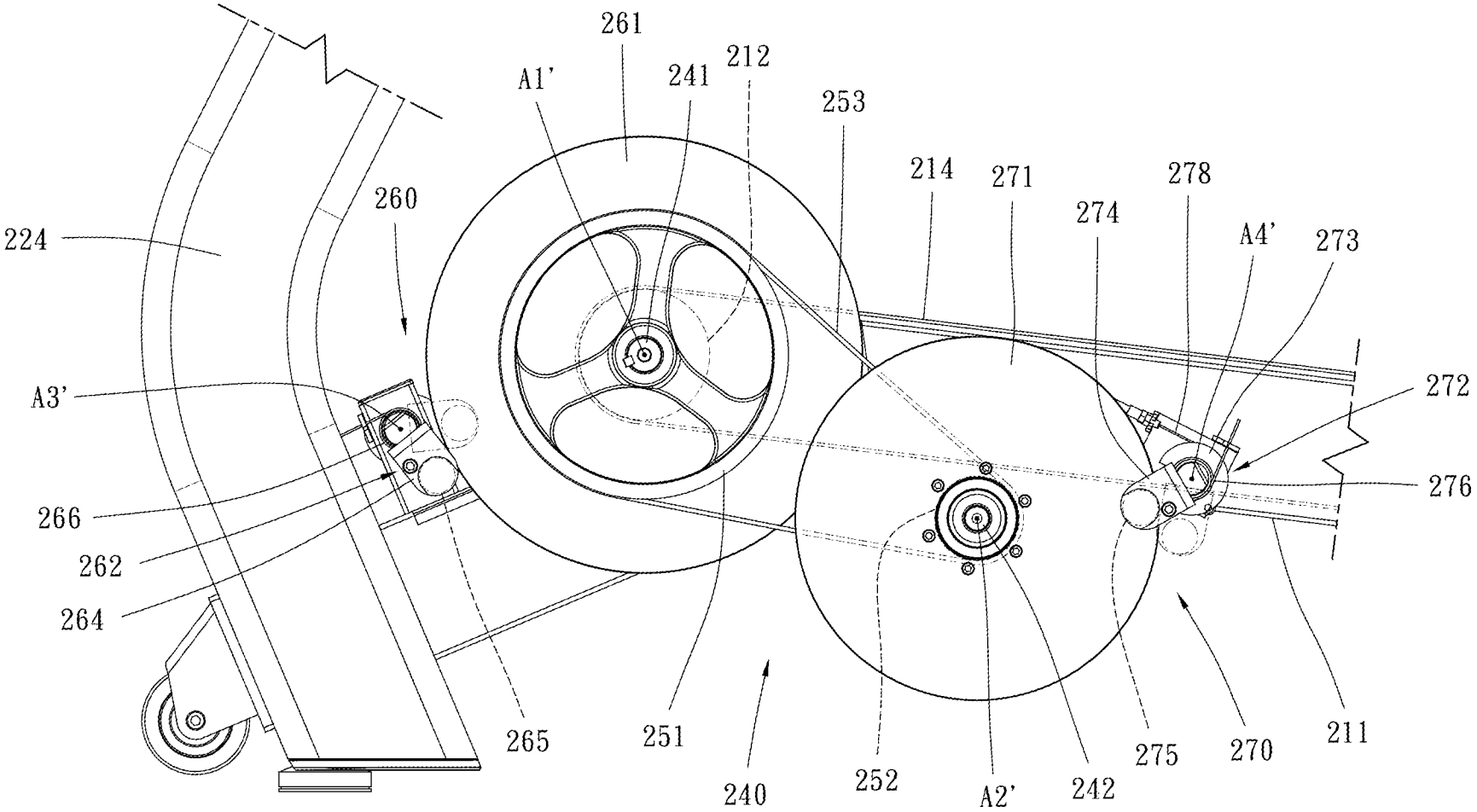
FIG. 15 is a side view of the resistance system shown in FIG. 13.

Referring to FIG. 15, when the endless belt 214 is rotated to drive the front roller 212 and the first rotating shaft 241 to rotate correspondingly, and the second rotating shaft 242 is simultaneously driven by the transmission mechanism (namely the first transmission wheel 251, the transmission belt 253 and the second transmission wheel 252) to rotate at a relatively high rotational speed. The transmission belt 253 is rotated to transmit power, and the force applied to the first transmission wheel 251 is equal to the force applied to the second transmission wheel 252. Besides, the torque that the first transmission wheel 251 applies to the first rotating shaft 241 is greater than the torque that the second transmission wheel 252 applies to the second rotating shaft 242. Since the radius of the first transmission wheel 251 is greater than the radius of the second transmission wheel 252, the torque of the first rotating shaft 241 is greater than the torque of the second rotating shaft 242. The magnitude of the torque is proportional to the diameter of the transmission wheel, namely inversely proportional to the rotational speed. In the present embodiment, the torque of the first rotating shaft 241 is about 3.2 times greater than the torque of the second rotating shaft 242.

The first resistance device 260 is configured to apply a first resistance against rotation of the first rotating shaft 241. In the preferred embodiment, the first resistance device 260 is substantially a conventional eddy current brake (ECB), which includes a first metal disc 261 and a first magnetic field generating unit 262. The first metal disc 261 is made of a metal which is a good conductor such as aluminum, copper or its alloys. The first metal disc 261 is coaxially fixed on the outer end of the first rotating shaft 241 and located at the inner side (namely right side) of the first transmission wheel 251, and the outer diameter of the first metal disc 261 is moderately larger than the first transmission wheel 251. The first magnetic field generating unit 262 is mounted in front of the first metal disc 261 for generating a variable magnetic field to the first metal disc 261, which includes a deflection disc 263, a bracket 264 and two magnets 265. The deflection disc 263 is pivotally mounted on the support frame 211 according to a third axis A3'. The bracket 264 is fixed to the outside of the deflection disc 263 and is deflected along with the deflection disc 263 about the third axis A3'. The bracket 264 has two parallel side walls (not numbered) opposite to each other, and the two magnets 265 are respectively disposed at inner sides of the two side walls such that the two magnets 265 are opposite to each other. As shown in FIG. 16, the left and right magnets 265 are respectively located at the inner and outer sides of the first metal disc 261 and each magnet 265 is spaced a suitable distance apart from the first metal disc 261.

Furthermore, a torsion spring 266 is mounted around the bracket 264, which has one end abutting against the bracket 264 and the other end abutting against the support frame 211. The torsion spring 266 is configured to bias the bracket 264 to deflect in a predetermined rotational direction about the third axis A3. In the present embodiment, the torsion spring 266 is configured to bias the bracket 264 to deflect in a counterclockwise direction. For example, as shown in FIG. 15, the bracket 264 is deflected counterclockwise from the position depicted by solid lines (the outermost position) to the position depicted by broken lines (the innermost position). The angular positions of the deflection disc 263 and the bracket 264 with respect to the support frame 211 is adjustable for changing the overlapping area between the inner surfaces of the two magnets 265 and the disc surface of the first metal disc 261. When the first metal disc 261 rotates with the first rotating shaft 241 and the first metal disc 261 moves through the magnetic field between the two magnets 265 of the first magnetic field generating unit 262, the two magnets 265 exert a drag force on the first metal disc 261 which opposes its motion, due to eddy current effects. In the present embodiment, it uses such drag force as the aforementioned first resistance generated by the first resistance device 260 to resist against rotation of the first rotating shaft 241.

Figure 14:
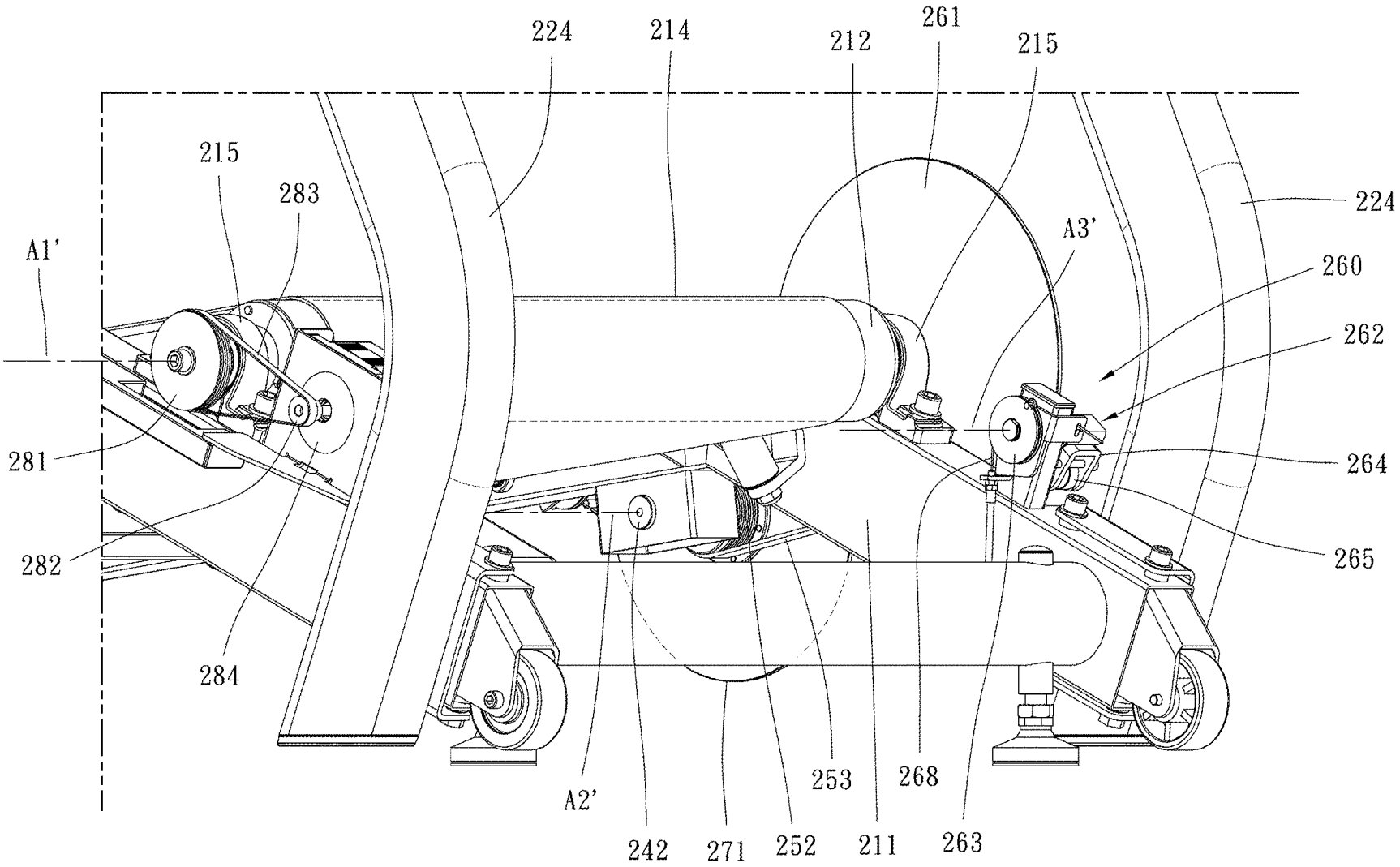
FIG. 14 illustrates the front end of the platform of the exercise apparatus shown in FIG. 12.

The exercise apparatus 200 further comprises a first control interface 267 for operation by the user to control the first resistance device 260 as shown in FIG. 12. In the preferred embodiment, the first control interface 267 is substantially a cable shifter device (a conventional device, common in multi-speed bicycles). The first control interface 267 is arranged on a position of the right side frame 222 suitable for the user's right hand operation, and has a lever for multistage control, for example, the lever may be pushed/pulled to adjust the resistance within 10 stages or levels. A first steel cord 268 has one end connected to the deflection disc 263 of the first magnetic field generating unit 262, as shown in FIG. 14, and the other end connected to the cable shifter device namely the first control interface 267, so that the cable shifter device is able to shorten or lengthen the first steel cord 268 for stage controlling the deflection disc 263 and the angular position of the bracket 264. In detail, when the lever of the cable shifter device is pulled to a lower stage, the first steel cord 268 is shortened by a short length and its tightening force is against the elastic force of the torsion spring 266, such that the bracket 264 is deflected a corresponding angle toward the outermost position in the clockwise direction, as shown in FIG. 15. In contrast, when the lever of the cable shifter device is pushed to a higher stage, the first steel cord 268 is lengthened by a short length and the torsion spring 266 pushes the bracket 264 to deflect a corresponding angle toward the innermost position in the counterclockwise direction.

When the bracket 264 is located at the outermost position, the aforementioned two magnets 265 and the first metal disc 261 do not overlap at all, and the magnetic flux through the first metal disc 261 is smallest and the generated eddy current resistance is also smallest (at the same rotational speed). In contrast, when the bracket 264 is located at the innermost position, the two magnets 265 and the first metal disc 261 are completely overlapped, and the magnetic flux through the first metal disc 261 is largest and the generated eddy current resistance is also largest (at the same rotational speed). The shortened or lengthened length of the first steel cord 268 at each stage has a specific value in accordance with the deflection angle of the bracket 264 at each stage, namely the variation of the overlapping area between the two magnets 265 and the first metal disc 261 as the lever of the cable shifter device adjusts for one stage is substantially equal. For example, if the bracket 264 has ten angular positions to choose, the magnetic flux variation at each stage is equal to one ninth of the difference between the maximum magnetic flux and the minimum magnetic flux. Under this arrangement, the user is able to control the first resistance of the first resistance device 260 that applies on the first rotating shaft 241 via the first control interface 267 (namely the cable shifter device) by means of stage adjustment.

The second resistance device 270 is configured to apply a second resistance against rotation of the second rotating shaft 242. In the preferred embodiment, the second resistance device 270 is also substantially a conventional eddy current brake (ECB) as the first resistance device 260, which includes a second metal disc 271 and a second magnetic field generating unit 272. The second metal disc 271 is coaxially fixed on the outer end of the second rotating shaft 242 and located at the outer side (namely left side) of the second transmission wheel 252. The first metal disc 261 and the second metal disc 271 are staggered in the left-right direction as shown in FIG. 16, but the two metal discs 261, 271 may be overlapped in the front-rear direction as shown in FIG. 15 for shortening the length of the resistance system 240. The second magnetic field generating unit 272 is mounted behind the second metal disc 271, which includes a deflection disc 273, a bracket 274 and two magnets 275. The deflection disc 273 is pivotally mounted on the support frame 211 according to a fourth axis A4'. The bracket 274 is fixed to the outside of the deflection disc 273 and is deflected along with the deflection disc 273 about the fourth axis A4'. The two magnets 275 are respectively disposed at inner sides of two side walls of the bracket 274, so that the two magnets 275 are respectively located at the inner and outer sides of the second metal disc 271 and each magnet 275 is spaced a suitable distance apart from the second metal disc 271. Furthermore, a torsion spring 276 is mounted around the bracket 274 for biasing the bracket 274 to deflect clockwise as shown in FIG. 4. For example, as shown in FIG. 15, the bracket 274 is deflected clockwise from the position depicted by broken lines (the outermost position) to the position depicted by solid lines (the innermost position). Similarly, when the second metal disc 271 rotates with the second rotating shaft 242 and the second metal disc 271 moves through the magnetic field between the two magnets 275 of the second magnetic field generating unit 272, the two magnets 275 exert a drag force on the second metal disc 271 which opposes its motion, due to eddy current effects, as the second resistance device 270 generates the aforementioned second resistance to resist against rotation of the second rotating shaft 242.

Correspondingly, the exercise apparatus 200 has a second control interface 277 for operation by the user to control the second resistance device 270 as shown in FIG. 1. In the preferred embodiment, the second control interface 277 is substantially a cable shifter device as mentioned before, which is arranged on a position of the left side frame 221 suitable for the user's left hand operation. A second steel cord 278 is connected between the deflection disc 273 of the second magnetic field generating unit 272 and the cable shifter namely the second control interface 277 for stage controlling the deflection disc 273 and the angular position of the bracket 274. When the bracket 274 of the second magnetic field generating unit 272 is located at the outermost position, the second resistance is smallest (at the same rotational speed). In contrast, when the bracket 274 is located at the innermost position, the second resistance is largest (at the same rotational speed). As the first control interface 267 controls the first resistance device 260, when the second control interface 268 controls the bracket 274 of the second magnetic field generating unit 272 to deflect for one stage at each time, the variation of the second resistance of the second resistance device 270 that applies on the second rotating shaft 242 is substantially equal.

The first control interface 267 and the second control interface 277 together constitute a control system of the exercise apparatus 200 for being operable to control the first resistance of the first resistance device 260 and the second resistance of the second resistance device 270. Besides, the first resistance device 260 and the second resistance device 270 are able to be controlled independently. In another embodiment (not shown), the aforementioned control system may be achieved by means of electronic control to control the first resistance device and the second resistance device. For example, the deflection angle of the bracket can be control by a servo motor. Correspondingly, the control interface can be replaced by electronic keys or buttons which are electrically connected to the servo motor. Furthermore, in another embodiment (not shown), the magnetic field generating unit may replace permanent magnet with electromagnet. The position of the electromagnet is fixed and the adjacent to the disc surface of the metal disc, thus the magnetic field can be adjusted by varying the input electric current via the control interface so as to control the eddy current resistance.

It has been mentioned that the exercise apparatus 200 does not have any power device, so that the user needs to push the endless belt 214 to rotate with two feet for performing exercises of walking, jogging or running. The output of the user must overcome the rotational resistance of the front roller 212, the rear roller 213, the first rotating shaft 241 and the second rotating shaft 242 to push the endless belt to rotate. The first resistance device 260 is operable to apply the first resistance against rotation of the first rotating shaft 241. The second resistance device 270 is operable to apply the second resistance against rotation of the second rotating shaft 242. The second rotating shaft 242 is connected to the endless belt 214 via the transmission mechanism, so that the user has to overcome not only the first resistance of the first rotating shaft 241 but also the second resistance of the second rotating shaft 242. As mentioned previous, the rotational speed of the second rotating shaft 242 is about 3.2 times greater than the rotational speed of the first rotating shaft 241, so the torque of the first rotating shaft 241 is about 3.2 times greater than the torque of the second rotating shaft 242. That is, assuming that the second rotating shaft 242 requires at least 100 N·m to overcome its rotational resistance (for the most part of the second resistance), the first rotating shaft 241 requires 320 N·m in order to drive the second rotating shaft 242. In short, in the preferred embodiment, the second resistance device 270 applies a unit of rotational resistance (namely the second resistance) to the second rotating shaft 242, which is equivalent to apply 3.2 units of rotational resistance to the first rotating shaft 241 (differ from the first resistance), in other words, the second resistance increases/decrease by a unit, the rotational resistance of the first rotating shaft 242 increase/decrease by 3.2 units.

It should be noted that both the first resistance device 260 and the second resistance device 270 are eddy current brake. The eddy current resistance that resists rotation of the metal disc is proportional to the rotational speed of the metal disc itself, namely the faster the rotational speed, the greater the rotational resistance. It is assumed that the structure of the two resistance devices 260, 270 is the same, including the material, size of metal discs 261, 271, and the material, size, position of the magnets 265, 275 of the magnetic field generating units 262, 272 are the same. The rotational speed of the second metal disc 271 on the second rotating shaft 242 is about 3.2 times greater than the rotational speed of the first metal disc 261 on the first rotating shaft 241, so that if the magnets 265, 275 of the two magnetic field generating units 262, 272 completely overlap the respective metal discs 261, 271, the second resistance applied by the second resistance device 270 to the second rotating shaft 242 is about 3.2 times greater than the first resistance applied by the first resistance device 260 to the first rotating shaft 241. Additionally, due to enlargement effect of the aforementioned transmission mechanism, the maximum amount of the rotational resistance indirectly applied by the second resistance device 270 to the first rotating shaft 241 may be about 10 times greater than the rotational resistance (namely the first resistance) applied by the first resistance device 260 to the first rotating shaft 241. Of course, the resistance source of the first and second resistance devices is not limited to magnetic resistance, for example, other resistance sources such as friction resistance, fluid resistance, and elastic resistance may also be used.

The first resistance applied by the first resistance device 260 to the first rotating shaft 241 against rotation of the endless belt 214 is defined as a first exercise resistance, and the second resistance applied by the second resistance device 270 to the second rotating shaft 242 against rotation of the moving member is defined as a second exercise resistance. The variation of the first exercise resistance is relatively smooth. For example, when the first resistance increases/decreases 1 kilogram-force, the exercise resistance may increase/decrease about merely 1 kilogram-force. In contrast, the variation of the second exercise resistance is relatively violent. For example, when the second resistance increases/decreases 1 kilogram-force, the exercise resistance may increase/decrease about 3.2 kilogram-force. For the exercise apparatus 200, the first resistance applied by the first resistance device 260 to the first rotating shaft 241 is suitable for relatively light resistance, and the second resistance applied by the second resistance device 270 to the second rotating shaft 242 is suitable for relatively large resistance. Therefore, when the user chooses to perform exercise of walking, jogging or running under the first operation mode upon the exercise apparatus 200, it is able to control the first resistance device 260 through the first control interface 267 to produce a desired first resistance, so that the endless belt 214 has a relatively light exercise resistance. In contrast, when the user chooses to perform weight training under the second operation mode upon the exercise apparatus 200, it is able to control the second resistance device 270 through the second control interface 270 to produce a desired second resistance, so that the endless belt 214 has a relatively large resistance. Preferably, the magnitude of the first exercise resistance in which the first resistance is adjusted to a maximum value is smaller than variation of the second exercise resistance in which the second resistance is adjusted for one stage.

Furthermore, since the rotational resistances of the first rotating shaft 241 and the second rotating shaft 242 will become the exercise resistance of the endless belt 214, and the first resistance applied by the first resistance 260 to the first rotating shaft 241 and the second resistance applied by the second resistance 270 to the second rotating shaft 242 are able to be controlled independently, so that the user can arrange an individual resistance according to the requirement. For example, when performing the weight training, it is able to control the second resistance device 270 to produce a roughly basic resistance and slightly and to control the first resistance device 260 to produce additional resistance for adjustment.

In the aforementioned embodiment, the control system of the exercise apparatus 200 includes separated first and second control interfaces 267, 268 for controlling the first resistance device 260 and the second resistance device 270. But in another embodiment (not shown), the control system of the exercise apparatus may have only one control interface. The user can control the resistance of the first and second resistance devices by means of a central control circuit (e.g. a microprocessor) in an electrically controlled manner, as long as the desired total resistance is input through the control interface.

Referring to FIG. 14, in the preferred embodiment, the left end of the front roller 212 (on the left side of the figure) coaxially mounts a large pulley 281, and a power generation module 284 is disposed in front of the large pulley 281. The power generation module 284 has a central shaft coaxially connected with a small pulley 282. A transmission belt 283 is mounted around the large pulley 281 and the small pulley 282. Therefore, when performing exercise of walking, jogging or running, the rotational movement of the front roller 212 can drive the power generation module 284 to generate electric power for supplying power to a display interface 290 mounted on the front side frame 223 as shown in FIG. 1. By monitoring the power generation status of the power generation module, it is able to know the rotational speed and number of turns of the front roller 212, and displaying the exercise information such as running speed, total distance for the user.

The resistance system of the present invention can be applied to various exercise apparatuses such as non-electric treadmills, stationary exercise bikes, elliptical trainers, rowing machines, stair exerciser apparatuses and weight training devices.

According to the superior concept of the present invention, the first rotating shaft and the second rotating shaft of the resistance system are rotated relative to each other at a predetermined transmission ratio. One of the two rotating shafts (assuming the first rotating shaft) is directly coupled to the moving member (e.g. treadmill belt, pedals, or handle) without the transmission mechanism, and the other rotating shaft (assuming the second rotating shaft) is coupled to the moving member via the transmission mechanism. In the preferred embodiment, the rotational speed of the second rotating shaft is higher than the rotational speed of the first rotating shaft. The second resistance of the second rotating shaft with a relatively fast rotational speed can produce a relatively large exercise resistance, and the first resistance of the first rotating shaft with a relatively slow rotational speed can produce a relatively small and easy fine adjustment exercise resistance.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

The invention claimed is:

1. An exercise apparatus comprising:

a platform having a front roller, a rear roller, and an endless belt mounted around the front roller and the rear roller for allowing a user to perform a first exercise type of a relatively lower resistance or a second exercise type of a relatively higher resistance, an upper surface of the belt between the front and rear rollers being substantially flat, wherein a resistance level applied to the endless belt is modifiable for each of the first and second exercise types;

a front frame mounted at a front side of the platform, and having at least one holding portion adapted to be grasped by the user;

a first resistance device and a second resistance device each configured to apply resistance to the endless belt for each of the first exercise type and the second exercise type; and one or more control interfaces configured to control resistance of the endless belt via the first and second resistance devices while the user is performing the first exercise type and while the user is performing the second exercise type.

2. An exercise apparatus as claimed in claim 1, wherein the one or more control interfaces includes a first symbol associated with the first exercise type and a second symbol associated with the second exercise type.

3. An exercise apparatus as claimed in claim 2, wherein the first symbol comprises a first human figure represented as performing the first exercise type, and the second symbol comprises a second human figure represented as performing the second exercise type.

4. An exercise apparatus as claimed in claim 3, wherein the first symbol comprises a running person with a parachute, and the second symbol comprises a person pushing a weight.

5. An exercise apparatus as claimed in claim 1, wherein the one or more control interfaces comprises a first control interface having a first lever and a second control interface having a second lever.

6. An exercise apparatus as claimed in claim 1, wherein the first and second resistance devices are controllable by the one or more control interfaces to adjust a resistance level of the endless belt.

7. An exercise apparatus configured to allow a user to perform a first exercise type of a relatively lower resistance or a second exercise type of a relatively higher resistance, the exercise apparatus comprising:

a platform having a front roller, a rear roller and an endless belt mounted around the front roller and the rear roller;

a resistance device configured to adjust a resistance level of the endless belt;

a frame coupled to the platform;

a restricting device coupled to the frame and configured to restrict forward motion of the user while the user is performing the first exercise type;

at least one holding portion coupled to the frame and adapted to be grasped by the user while the user is performing the second exercise type; and a control interface configured to control the resistance device to adjust the resistance level of the endless belt for each of the first and second exercise types, wherein the control interface includes a first symbol associated with the first exercise type and a second symbol associated with the second exercise type, and wherein the first symbol comprises a first human figure represented as performing the first exercise type, and the second symbol comprises a second human figure represented as performing the second exercise type.

8. An exercise apparatus as claimed in claim 7, wherein the first symbol is one of two first symbols associated with the first exercise type.

9. An exercise apparatus as claimed in claim 8, wherein a first of the two first symbols includes a first parachute symbol having a first size to represent a relatively lower resistance level of the endless belt, and a second of the two first symbols includes a second parachute symbol having a second size to represent a relatively greater resistance level of the endless belt, the second size being larger than the first size.

10. An exercise apparatus as claimed in claim 7, wherein the restricting device is a strap.

11. An exercise apparatus configured to allow a user to perform a first exercise type configured to simulate moving with an attached parachute and a second exercise type configured to simulate pushing a weight forward, the exercise apparatus comprising:

a platform having a front roller, a rear roller and an endless belt mounted around the front roller and the rear roller;

a resistance device configured to adjust a resistance level applied to the endless belt, the resistance level being modifiable for each of the first and second exercise types;

a frame coupled to the platform;

a strap coupled to the frame and configured to restrict forward motion of the user while the user is performing the first exercise type;

at least one holding portion coupled to the frame and adapted to be grasped by the user while the user is performing the second exercise type;

a first control interface configured to control the resistance level applied to the endless belt when performing the first exercise type; and a second control interface configured to control the resistance level applied to the endless belt when performing the second exercise type.

12. An exercise apparatus as claimed in claim 11, wherein the first control interface includes two first symbols associated with the first exercise type.

13. An exercise apparatus as claimed in claim 12, wherein a first of the two first symbols includes a first parachute symbol having a first size to represent a relatively lower resistance of the endless belt, and a second of the two first symbols includes a second parachute symbol having a second size to represent a relatively greater resistance of the endless belt, the second size being larger than the first size.

14. An exercise apparatus as claimed in claim 11, further comprising:

a first symbol associated with the first control interface; and a second symbol associated with the second control interface.

15. An exercise apparatus as claimed in claim 14, wherein the first symbol comprises a running person dragging a parachute, and the second symbol comprises a person pushing a weight.

* * * * *